US011092905B2

(12) United States Patent
Fukudome et al.

(10) Patent No.: US 11,092,905 B2
(45) Date of Patent: Aug. 17, 2021

(54) TONER

(71) Applicant: CANON KABUSHIKI KAISHA, Tokyo (JP)

(72) Inventors: Kosuke Fukudome, Tokyo (JP); Tetsuya Kinumatsu, Mishima (JP); Koji Nishikawa, Susono (JP); Takaaki Furui, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/701,412

(22) Filed: Dec. 3, 2019

(65) Prior Publication Data

US 2020/0183294 A1 Jun. 11, 2020

(30) Foreign Application Priority Data

Dec. 10, 2018 (JP) ..... JP2018-230665

(51) Int. Cl.
*G03G 9/087* (2006.01)

(52) U.S. Cl.
CPC ..... *G03G 9/08711* (2013.01); *G03G 9/08755* (2013.01)

(58) Field of Classification Search
CPC ..... G03G 9/083; G03G 9/08708; G03G 9/08722; G03G 9/08725; G03G 9/0825
See application file for complete search history.

(56) References Cited

U.S. PATENT DOCUMENTS 7,273,686 B2 9/2007 Onuma et al.
7,288,354 B2 10/2007 Moribe et al.
7,351,509 B2 4/2008 Moribe et al.
7,422,832 B2 9/2008 Ogawa et al.
7,582,401 B2 9/2009 Ogawa et al.
7,745,089 B2 6/2010 Okubo et al.
8,603,712 B2 12/2013 Aoki et al.
8,652,728 B2 2/2014 Mine et al.
8,741,519 B2 7/2014 Watanabe et al.
8,846,284 B2 9/2014 Kinumatsu et al.
9,034,549 B2 5/2015 Shiotari et al.
(Continued)

FOREIGN PATENT DOCUMENTS

EP 1 967 911 9/2008
EP 2 837 971 2/2015
(Continued)

OTHER PUBLICATIONS

U.S. Appl. No. 16/583,945, Kosuke Fukudome, filed Sep. 26, 2019.
(Continued)

*Primary Examiner* — Peter L Vajda
(74) *Attorney, Agent, or Firm* — Venable LLP

(57) ABSTRACT

A toner including: a toner particle that includes a binder resin; and an external additive, wherein a toner hardness A N/m and a toner hardness B N/m satisfy B≥600 and B/A≥1.30, in the formulas, the toner hardness A is an average value of a slope in a displacement region of from 0.00 μm to 0.20 μm when measuring the toner under a condition of a load application speed of 0.83 μN/sec, and the toner hardness B is an average value of a slope in a displacement region of from 0.00 μm to 0.20 μm when measuring the toner under a condition of a load application speed of 2.50 μN/sec.

10 Claims, 1 Drawing Sheet

(56) References Cited

U.S. PATENT DOCUMENTS

| | | | |
|---|---|---|---|
| 9,040,216 | B2 | 5/2015 | Fukudome et al. |
| 9,116,448 | B2 | 8/2015 | Terauchi et al. |
| 9,134,637 | B2 | 9/2015 | Hotta et al. |
| 9,141,012 | B2 | 9/2015 | Moribe et al. |
| 9,201,323 | B2 | 12/2015 | Nishikawa et al. |
| 9,261,804 | B2 | 2/2016 | Yamazaki et al. |
| 9,261,806 | B2 | 2/2016 | Moribe et al. |
| 9,285,697 | B2 | 3/2016 | Fukudome et al. |
| 9,309,349 | B2 | 4/2016 | Watanabe et al. |
| 9,341,970 | B2 | 5/2016 | Yoshiba et al. |
| 9,429,860 | B2 | 8/2016 | Kinumatsu et al. |
| 9,470,993 | B2 | 10/2016 | Nishikawa et al. |
| 9,588,450 | B2 | 3/2017 | Tsuda et al. |
| 9,594,323 | B2 | 3/2017 | Fujikawa et al. |
| 9,606,462 | B2 | 3/2017 | Nomura et al. |
| 9,625,844 | B2 | 4/2017 | Kaya et al. |
| 9,658,554 | B2 | 5/2017 | Kinumatsu et al. |
| 9,715,188 | B2 | 7/2017 | Terauchi et al. |
| 9,772,570 | B2 | 9/2017 | Tsuda et al. |
| 9,798,256 | B2 | 10/2017 | Kosaki et al. |
| 9,798,262 | B2 | 10/2017 | Toyoizumi et al. |
| 9,811,016 | B2 | 11/2017 | Aoki et al. |
| 9,823,595 | B2 | 11/2017 | Toyoizumi et al. |
| 9,829,818 | B2 | 11/2017 | Yoshiba et al. |
| 9,857,713 | B2 | 1/2018 | Kosaki et al. |
| 9,869,943 | B2 | 1/2018 | Aoki et al. |
| 9,971,263 | B2 | 5/2018 | Fukudome et al. |
| 10,101,683 | B2 | 10/2018 | Nishikawa et al. |
| 10,197,934 | B2 | 2/2019 | Matsui et al. |
| 10,289,016 | B2 | 5/2019 | Fukudome et al. |
| 10,295,920 | B2 | 5/2019 | Nishikawa et al. |
| 10,295,921 | B2 | 5/2019 | Ohmori et al. |
| 10,303,075 | B2 | 5/2019 | Tanaka et al. |
| 10,409,180 | B2 | 9/2019 | Koji et al. |
| 10,545,420 | B2 | 1/2020 | Kinumatsu et al. |
| 10,845,722 | B2 * | 11/2020 | Nishikawa ..... G03G 9/0833 |
| 2012/0094229 | A1 | 4/2012 | Mine et al. |
| 2015/0037719 | A1 | 2/2015 | Naka et al. |
| 2015/0125790 | A1 | 5/2015 | Hotta et al. |
| 2015/0220013 | A1 | 8/2015 | Nishikawa et al. |
| 2016/0085167 | A1 | 3/2016 | Yoshihara et al. |
| 2016/0161874 | A1 | 6/2016 | Yamazaki et al. |
| 2017/0307993 | A1 * | 10/2017 | Sano ..... G03G 9/09733 |
| 2020/0081361 | A1 | 3/2020 | Yoshiba et al. |

FOREIGN PATENT DOCUMENTS

| | | |
|---|---|---|
| JP | S61-292160 | 12/1986 |
| JP | 2002-202628 | 7/2002 |
| JP | 2009-156902 | 7/2009 |
| JP | 2012-108485 | 6/2012 |
| JP | 2016-038459 | 3/2016 |
| JP | 2018-036596 | 3/2018 |
| WO | 2013/100182 | 7/2013 |
| WO | 2013/115412 | 8/2013 |

OTHER PUBLICATIONS

U.S. Appl. No. 16/584,346, Tetsuya Kinumatsu, filed Sep. 26, 2019.
U.S. Appl. No. 16/701,412, Kosuke Fukudome, filed Dec. 3, 2019.
U.S. Appl. No. 16/728,082, Yasuhiro Hashimoto, filed Dec. 27, 2019.
U.S. Appl. No. 16/728,115, Shotaro Nomura, filed Dec. 27, 2019.
U.S. Appl. No. 16/728,171, Takaaki Furui, filed Dec. 27, 2019.
U.S. Appl. No. 16/728,179, Koji Nishikawa, filed Dec. 27, 2019.
U.S. Appl. No. 16/701,260, Koji Nishikawa, filed Dec. 3, 2019.
U.S. Appl. No. 16/701,292, Tetsuya Kinumatsu, filed Dec. 3, 2019.

* cited by examiner

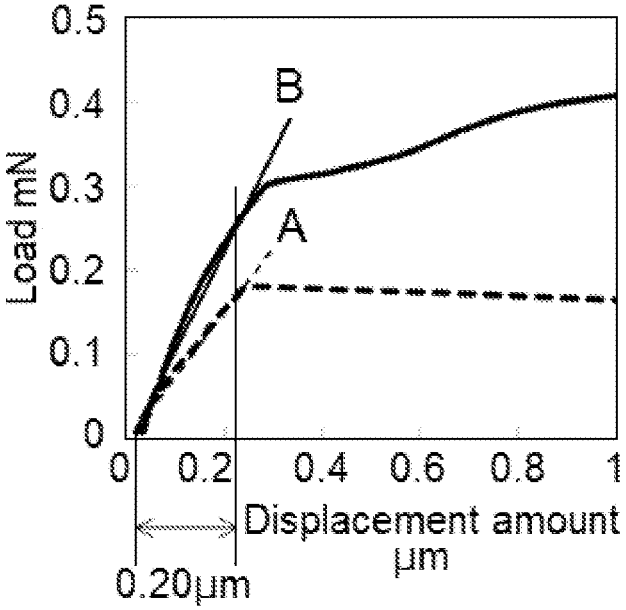
0.5
0.4
0.3
0.2
0.1
0
Load mN
B
A
0
0.2
0.4
0.6
0.8
1
Displacement amount
μm
0.20μm

TONER

BACKGROUND OF THE INVENTION

Field of the Invention

The present invention relates to a toner to be used in an image forming method such as electrophotography.

Description of the Related Art

In the field of electrophotographic image forming apparatuses, there are increasing user demands for higher speed, higher image quality, longer life, energy saving, and media compatibility.

From the viewpoint of speeding up and energy saving, there is a demand for a toner that further excels in low-temperature fixing performance. From the viewpoints of diversifying user usage environment and effectively utilizing paper resources, the use of rough paper with larger surface irregularities than before is increasing.

In such rough paper, the adhesion of the toner to the paper tends to deteriorate, and image defects may occur particularly when the adhesive tape is peeled off after being applied to the image area, and improvement in toner fixing performance is required (tape peeling resistance).

The tape peeling resistance on rough paper tends to improve when the process speed of the fixing means is reduced, the contact pressure between a fixing film and a pressure roller is increased, and a nip width is enlarged. However, a reduction in process speed has a trade-off relationship with high-speed output, and an increase in contact pressure may cause a reduction in the life of the fixing means.

Therefore, there is a demand for a toner that exhibits good tape peeling resistance on rough paper even in a fixing means that is set at high speed and light pressure.

Meanwhile, from the viewpoint of high image quality, especially fine line reproducibility, a contact development system in which a photosensitive drum and a developing roller bearing the toner are in contact with each other is preferably used because a latent image formed on a photosensitive drum can be easily faithfully reproduced with a toner.

However, in an electrophotographic image forming apparatus of the contact development system, toner deterioration easily proceeds because a load applied to the toner is large between the developing roller and the photosensitive drum. Further, in the contact developing system with increased speed, toner deterioration during the durability use tends to progress even more easily, so that the reduction in fine line reproducibility tends to be promoted.

Specifically, after long-term durability use, the line width on rough paper may become thin (line width maintenance ratio), or the line thickness may be uneven and may be easily lost (line width stability).

In terms of size reduction of an electrophotographic image forming apparatus, miniaturization of parts and reduction of the number of parts are important factors. For example, in the contact development system, reduction in the diameter of the developing roller, reduction in the number of conveying rollers that convey a toner to the developing roller, and elimination of a cleaning mechanism are effective measures for size reduction.

However, from the viewpoints of increasing the contact pressure with the blade and the photosensitive drum, lowering the toner circulation property, and collecting the waste toner, a system in which all these measures are realized causes a more severe toner deterioration. Therefore, further improvement in toner durability is required.

Thus, further improvement of fixing performance and durability of toners is required, and various studies thereof have been conducted. For example, a core-shell structure has been proposed for a toner to achieve both low-temperature fixing performance and durability.

Japanese Patent Application Publication No. 2009-156902 proposes that the hardness of toner be defined using a nanoindentation method and a microindentation method. In Japanese Patent Application Publication No. 2009-156902, the toner has a core-shell structure using a first binder resin and a second binder resin and the toner particle is softened on the inside and hardened on the outside, thereby providing the toner with good resistance to mechanical stress and good fixing performance.

Japanese Patent Application Publication No. 2012-108485 discloses a toner including a shell layer including an amorphous polyester resin and a core particle including a binder resin composed of a crystalline polyester resin and an acrylic resin having a specific crosslinked structure.

Meanwhile, Japanese Patent Application Publication No. S61-292160 discloses a suspension-polymerized magnetic toner that is suspension-polymerized in the presence of a specific crosslinking agent.

SUMMARY OF THE INVENTION

Regarding the toner disclosed in Japanese Patent Application Publication No. 2009-156902, since only shell hardening is used, there is room for improvement in durability in the high-speed contact development system. There is also room for improvement in fixing performance on rough paper at high-speed and light-pressure settings.

Regarding the toner disclosed in Japanese Patent Application Publication No. 2012-108485, there is room for improvement in durability in the high-speed contact development system. There is also room for improvement in fixing performance on rough paper at high-speed and light-pressure settings.

Regarding the toner disclosed in Japanese Patent Application Publication No. S61-292160, there is room for improvement in fixing performance on rough paper at high-speed and light-pressure settings.

Thus, although a toner having good fixing performance on rough paper and good fine line reproducibility even in long-term use has been obtained, there is still room for improvement.

The present invention provides a toner that solves the above problems.

That is, the present invention provides a toner that has good fixing performance on rough paper even in a fixing means set at high speed and light pressure, and fine line reproducibility on rough paper even in long-term durability use in a high-speed contact development system.

The present invention provides a toner including: a toner particle that includes a binder resin; and an external additive, wherein a toner hardness A (N/m) and a toner hardness B (N/m) determined by a nanoindentation method satisfy following formulas (1) and (2).

$$B \geq 600 \quad (1)$$

$$B/A \geq 1.30 \quad (2)$$

In the formulas (1) and (2), the toner hardness A is an average value of a slope in a displacement region of from 0.00 μm to 0.20 μm in a load-displacement curve obtained by measuring the toner under a condition of a load application speed of 0.83 μN/sec where a load a (mN) is plotted against an ordinate, and a displacement amount b (μm) is plotted against an abscissa; and the toner hardness B is an average value of a slope in a displacement region of from 0.00 μm to 0.20 μm in a load-displacement curve obtained by measuring the toner under a condition of a load application speed of 2.50 μN/sec where a load a (mN) is plotted against an ordinate, and a displacement amount b (μm) is plotted against an abscissa.

According to the present invention, it is possible to provide a toner that has good fixing performance on rough paper even in a fixing means set at high speed and light pressure, and fine line reproducibility on rough paper even in long-term durability use in a high-speed contact development system.

Further features of the present invention will become apparent from the following description of exemplary embodiments with reference to the attached drawings.

BRIEF DESCRIPTION OF THE DRAWINGS

The FIGURE shows an example of a load-displacement curve obtained by a nanoindentation method and a differential curve thereof.

DESCRIPTION OF THE EMBODIMENTS

In the present invention, "from XX to YY" or "XX to YY" representing a numerical range means a numerical range including a lower limit and an upper limit as end points unless otherwise specified.

Also, the monomer unit refers to a form in which a monomer substance in a polymer has reacted.

As described above, as a means for achieving both low-temperature fixing performance and durability, for example, a toner has been proposed in which a core-shell structure is formed, the toner surface layer is designed to be hard, and the interior is designed to be soft.

However, according to the studies by the inventors of the present invention, it is difficult to obtain appropriate fixing performance when using rough paper and a fixing means with high-speed and light-pressure settings only with the toner design as described above.

In the fixing nip, pressure and heat are unlikely to be transmitted to the toner in recessed portions of the paper. For this reason, when a toner only having a hard surface layer is used, deformation or melt-spread of the toner present in the recessed portion in the fixing nip is hindered, and adhesion to the paper is lowered. This is why the above problem occurs.

To solve this problem, it is necessary to promote the toner fixing performance in the recessed portion of the paper.

However, where the surface layer of the toner is simply designed to be soft, especially when a durability test is performed in a high-temperature and high-humidity environment, the line width becomes narrow in the latter half of the durability test, which is a trade-off with durability (that is, the line width maintenance ratio decreases).

The inventors of the present invention think that this is caused by the progress of embedding of an external additive.

Meanwhile, when a durability test is performed in a low-temperature and low-humidity environment with a contact development system using a toner having a surface designed to be hard, the difference between the output line width after solid black image output and the output line width after white image output on rough paper in the second half of the durability tends to increase (that is, the line width stability decreases).

For this reason, the hard toner surface tends to be brittle, and in a durability test environment under a low-temperature and low-humidity environment, the stress applied to the toner tends to concentrate near the surface of the toner particle through the external additive. Therefore, it can be presumed that this is because minute cracks and defects are likely to occur near the toner surface.

As described above, it is very difficult to achieve both the fixing performance on rough paper (tape peeling resistance) and the long-term durability (line width maintenance ratio, line width stability) in the contact development system.

Based on the results of intensive studies conducted by the present inventors, it was found that the above-mentioned problems can be solved by taking a specific hardness as the hardness in the vicinity of the toner surface and imparting this hardness with a property to change depending on a deformation speed. The present invention has been accomplished based on this finding.

That is, the present invention provides a toner including a toner particle including a binder resin, and an external additive, wherein a toner hardness A (N/m) and a toner hardness B (N/m) determined by a nanoindentation method satisfy following formulas (1) and (2).

$$B \geq 600 \quad (1)$$

$$B/A \geq 1.30 \quad (2)$$

In the formulas (1) and (2), the toner hardness A is an average value of a slope in a displacement region of from 0.00 μm to 0.20 μm in a load-displacement curve obtained by measuring the toner under a condition of a load application speed of 0.83 μN/sec where a load a (mN) is plotted against an ordinate, and a displacement amount b (μm) is plotted against an abscissa; and the toner hardness B is an average value of a slope in a displacement region of from 0.00 μm to 0.20 μm in a load-displacement curve obtained by measuring the toner under a condition of a load application speed of 2.50 μN/sec where a load a (mN) is plotted against an ordinate, and a displacement amount b (μm) is plotted against an abscissa.

The inventors of the present invention came up with an idea that in order to achieve both fixing performance and durability, it is effective to impart the hardness in the vicinity of the toner particle surface with responsiveness to external force.

It was considered effective to impart a property of hardening only when an external force is applied, that is, to impart the surface hardness of the toner particle with dependency on the frequency of the force.

As a result of extensive studies conducted by the inventors of the present invention, it was found in order to realize such physical properties of the toner particle surface, it is possible to use a method of disposing a site (referred to hereinbelow as "tough site") that is harder than the outermost surface of the toner particle and has a fixed position on the inside in the vicinity of the toner particle surface.

Further, it is preferable to dispose a relatively soft resin on the outermost surface of the toner particle, and it is more preferable to dispose a resin having a crosslinked structure.

As a result of the toner particles having a flexible resin on the outermost surface thereof, the force applied to the external additive is transmitted to the tough site, and an effect of hardening the surface of the toner particle appears to be obtained due to a stress propagation effect. By this action, the toner particle can be imparted with a property that the surface of the toner particles becomes hard only when a force is applied to the toner. Further, due to such property, the concentration of residual stress in the vicinity of the external additive is alleviated, and minute cracks on the toner particle surface can be suppressed.

Hereinafter, a mechanism for improving long-term durability when the surface of the toner particle has a structure that exhibits the stress propagation effect will be described.

That is, the relationship between the stress propagation effect due to the surface structure of the toner particle and the improvement in long-term durability will be described.

The toner particle is subjected to stress by the developing unit parts and the photosensitive member through the external additive.

When the toner particle is subjected to stress, stress is generated from the external additive toward the toner particle and propagates inside the toner particle. In general, strains are generated in the stressed portion of the toner particle, and even if the force applied to the external additive is removed, the external additive does not return completely to the original position, and the external additive tends to be embedded inside the toner particle.

Meanwhile, as described above, when a tough site is present in the vicinity of the toner particle surface, the stress generated from the external additive propagates to the tough site inside the toner particle.

Since the tough site is sufficiently harder than the surface of the toner particle, strains are not generated by the generated stress and the position of the tough site does not change.

As a result, the stress propagated to the tough site generates a repulsive force toward the surface of the toner particle, the surface of the toner particles appears to be hardened, and the progress of strains on the toner particle surface is hindered.

As a consequence, embedding of the external additive on the toner particle surface is suppressed, and it is conceivable that the external additive is unlikely be embedded even in long-term use.

When no force is applied to the external additive, the above-described stress propagation effect does not occur, and the toner particle surface is not hardened. Therefore, it is possible to promote melting and spreading of the toner which is present in the recess portions of the paper and to which a load is relatively difficult to apply. Therefore, it is possible to achieve both fixing performance and long-term durability.

As a result of intensive studies, the inventors of the present invention have found that the nanoindentation method can be used as a method for evaluating the stress propagation effect. The nanoindentation method is a method for evaluating the mechanical properties of a microscopic region.

In the nanoindentation method, the thickness range of the sample to be evaluated was set to 0.20 μm, and two kinds of measured values for which different maximum load and load application speed were set were compared to obtain an index for toner evaluation.

The FIGURE is an example of a load-displacement curve obtained when a toner is evaluated by the nanoindentation method. The inventors consider the toner hardness A (hereinafter also simply referred to as "A", the unit is N/m) as a hardness of the toner measured when the depth of propagation of the stress is reduced and the stress does not propagate to the tough site as a result of reducing the indenter indentation speed of a nanoindenter within a range in which the evaluation in the vicinity of the toner particle surface is possible. Therefore, the A is an index of the hardness of the toner surface when it is relatively difficult to apply a load.

Meanwhile, the inventors consider the toner hardness B (hereinafter also simply referred to as "B", the unit is N/m) as a hardness of the toner measured when the depth of propagation of the stress is increased and the stress propagates to the tough site as a result of increasing the indenter indentation speed of the nanoindenter within a range in which the evaluation in the vicinity of the toner particle surface is possible.

Therefore, the B is an index of the ease of embedding the external additive when the external additive receives a force inside the developing device.

Where B≥600 (N/m), embedding can be suppressed even when the external additive receives a force in the developing device.

Where B is 600 or more, even when a durability test is performed in a high-temperature and high-humidity environment, a change in line width can be suppressed (line width maintenance ratio). The B is preferably 1000 or more, more preferably 1100 or more, and still more preferably 1200 or more. Meanwhile, the upper limit is not particularly limited, but is preferably 2500 or less, and more preferably 2200 or less. Examples of methods for designing a large toner hardness B include increasing the molecular weight of the resin constituting the binder resin, increasing the glass transition temperature (Tg) of the binder resin, introducing the structure derived from a crosslinking agent into the binder resin, and increasing the surface presence ratio of magnetic body.

B/A is an index indicating the magnitude of the stress propagation effect. When B/A is 1.30 or more, it indicates that the toner particle surface has a structure that can exhibit a high stress propagation effect.

When the toner is rubbed against other members in the developing device, the toner particle surface behaves as if being hard, so that a high stress propagation effect is exhibited and the effect of suppressing the embedding of the external additive can be maintained.

Further, when B/A is 1.30 or more, the fixing performance when using rough paper, in particular, the tape peeling resistance, is improved.

This is presumed to be the effect that is generated as a result of the toner exhibiting a property of being hard when a high load is applied to the toner particle surface, but being soft in the vicinity of the toner particle surface when the load is low.

Because of the above property, it is possible to promote the melting and spreading of the toner which is present in the recess portion of the paper and which is unlikely to be crushed by heating and pressurizing in the fixing nip. As a result, the adhesion to paper can be enhanced. Thereby, tape peeling resistance is improved.

Furthermore, even when performing a long-term durability test in a low-temperature and low-humidity environment, since the toner particle surface has properties that change depending on the frequency of force, the stress applied to the toner from various members is dispersed and is unlikely to be accumulated as internal stress. As a result, the occurrence of minute cracks on the toner particle surface is suppressed even in a low-temperature and low-humidity environment that is a severe environment for toner cracking.

As a result, when the durability test is performed in a low-temperature and low-humidity environment, the difference between the line width after the solid black image and the line width after the solid white image on rough paper is unlikely to change in the latter half of durability, that is, excellent line width stability is achieved.

Due to the above effect, not only the charge rising performance of the toner becomes satisfactory, but also it is possible to prevent the attachment force of the toner from being dispersed among the particles due to minute cracks on the surface of the toner particles. As a result, it is possible to suppress unevenness in development reproducibility of the line latent image after the solid white image and after the solid black image and also to suppress uneven transferability on rough paper.

From the viewpoint of obtaining the toner excellent in tape peeling resistance (fixing performance) and line width stability, the B/A is preferably 1.35 or more, and more preferably 1.40 or more. Meanwhile, the upper limit is not particularly limited, but is preferably 10.00 or less, and more preferably 8.00 or less. In order to increase the B/A, the below-described tough site may be provided.

More specifically, it is possible to increase the surface presence ratio of magnetic body, introduce a structure derived from a crosslinking agent into the binder resin, and adjust, as appropriate, the amount of the resin having a structure derived from the crosslinking agent and the amount of the structure derived from the crosslinking agent in the resin having the structure derived from the crosslinking agent.

In order to obtain the above-described properties, it is preferable, but not particularly limiting, to provide a tough site in the vicinity of the toner particle surface.

As the tough site, an inorganic fine particle may be present in the vicinity of the toner particle surface, or a resin portion harder than the outermost surface may be provided in the vicinity of the toner particle surface.

For example, a plurality of resin layers may be produced by using a suspension polymerization method and resins having different acid values.

Meanwhile, when inorganic fine particles are present, from the viewpoint of maintaining charging performance, it is preferable to use metal oxide particles. The metal oxide particles can be exemplified by at least one kind of oxide particles selected from the group consisting of iron oxide fine particles, silica fine particles, alumina fine particles, titania fine particles, zinc oxide fine particles, strontium titanate fine particles, cerium oxide fine particles, and calcium carbonate fine particles.

Also, composite oxide fine particles using two or more kinds of metals can be used, or two or more kinds of particles selected in any combination from this fine particle group can be used.

Among them, from the viewpoint of easily achieving both the tinting strength and charging performance of the toner, it is particularly preferable to form a tough site using a magnetic body such as an iron oxide fine particle.

When using inorganic fine particles for forming the tough sites, the number average particle diameter of primary particles of the inorganic fine particles is preferably from 50 nm to 500 nm, and more preferably from 50 nm to 300 nm.

In the toner, where a toner hardness value (N/m) is plotted against the ordinate, a load application speed (μN/sec) is plotted against the abscissa, and a segment of a straight line connecting the toner hardness A and the toner hardness B is taken as a toner hardness C (N/m) at a point of time at which the load application speed is 0.00 μN/sec, the value of C is preferably 850 or less.

The value of C is an index indicating the ease of deformation of the toner in the non-pressurized state.

Where the value of C is 850 or less, not only the degree of melting and deformation of the toner in the fixing nip is increased, but also the toner deformation under no pressure is promoted by the residual heat stored in the paper after leaving the fixing nip. Therefore, such a value is preferable because the tape peeling resistance on rough paper can be further improved. The value of C is more preferably 800 or less. Meanwhile, the lower limit is not particularly limited, but is preferably 200 or more, and more preferably 300 or more. The value of C can be controlled by combining the methods for controlling the A value and the B value.

The toner particle preferably includes a magnetic body.

Where a magnetic body is included, in addition to the effects of tinting and magnetic properties due to the magnetic body, the magnetic body can be unevenly distributed in a specific state in the vicinity of the toner surface to act as a tough site.

The amount of the magnetic body is preferably from 20 parts by mass to 100 parts by mass, and more preferably from 25 parts by mass to 90 parts by mass with respect to 100 parts by mass of the binder resin.

In observation of the toner surface using a scanning electron microscope, the surface presence ratio of the magnetic body obtained by image analysis of the toner particle surface at an accelerating voltage of 5.0 kV is preferably from 10% to 70%, more preferably from 15% to 65%, and even more preferably from 20% to 60%. The surface presence ratio can be controlled by increasing the amount of the magnetic body, reducing the particle diameter of the magnetic body, and selecting a production method, for example, by adopting a method of granulating, while suspending, the toner particles in an aqueous medium as in a suspension polymerization method.

When analyzing the image of the toner particle surface at an accelerating voltage of 5.0 kV, not only the surface of the toner particle but also the magnetic body present in the vicinity of the toner particle surface can be observed.

When the surface presence ratio of the magnetic body is in the above range, it is easy to form a tough site in the vicinity of the toner particle surface. As a result, a stress propagation effect can be obtained regardless of the direction of the force applied to the external additive in the developing device, and therefore the durability improvement effect is further enhanced.

Also, it is easy to achieve both the stress propagation effect due to the overlap with the external additive and the fixing inhibition suppression due to the filler effect at the time of fixing. This is preferable because durability can thus be improved while ensuring satisfactory low-temperature fixing performance.

When the surface presence ratio is 10% or more, in the durability evaluation in a high-temperature and high-humidity environment, embedding of the external additive in the second half of the durability can be further suppressed, and the durability is further improved. In addition, the letter reproducibility when using rough paper is further improved.

Meanwhile, when the surface presence ratio is 70% or less, the low-temperature fixing performance on rough paper becomes better, and the toner has less image deterioration caused by rubbing.

It is preferable that in the cross section of the toner particle observed with a transmission electron microscope (TEM), 75 number % or more (more preferably 85 number % or more, and even more preferably 100 number %) of the magnetic body contained in the toner particle be present within a distance of 0.15 times the projected area circle-equivalent diameter of the cross section from an outline of the cross section.

This indicates the degree to which the magnetic body in the toner particles is unevenly distributed in the vicinity of the toner particle surface, and is also referred to as the degree of uneven surface distribution of the magnetic body.

Where the toner has the above structure and the magnetic body is unevenly distributed in the vicinity of the toner particle surface, the stress propagation effect can be efficiently expressed without including an excessive amount of magnetic body. Therefore, embedding of the external additive in the second half of the durability can be further suppressed, and the durability is further improved. Further, the letter reproducibility when using rough paper is further improved. In order to increase the degree of uneven surface distribution, control can be performed by increasing the amount of the magnetic body, reducing the particle diameter of the magnetic body, and selecting a production method in which strong shear is applied in the granulation process by adopting a method of granulating, while suspending, the toner particles in an aqueous medium as in a suspension polymerization method.

The binder resin preferably includes a vinyl resin having an ether structure.

Where the binder resin includes a vinyl resin having an ether structure, the surface and the inside of the toner particle tend to behave flexibly and elastically, and the microscopic cracks and internal strains on the toner surface in a low-temperature and low-humidity environment can be suppressed. Therefore, it is easy to improve the durability in a low-temperature and low-humidity environment.

Where an intensity of secondary ion mass/secondary ion charge number (m/z)=59, 44, and 135 is denoted by D (ppm), E (ppm), and F (ppm), respectively, in the measurement of the toner by time-of-flight secondary ion mass spectrometry (TOF-SIMS), the intensities at 100 nm from a surface of the toner satisfy the relationship of the following formula (3).

By satisfying the following formula (3), dot reproducibility in a low-temperature and low-humidity environment is further improved.

$$F/(D+E) \leq 1.50 \quad (3)$$

The F/(D+E) shows the mixing ratio of a component derived from propylene oxide (D; m/z=59), a component derived from ethylene oxide (E; m/z=44), and a component derived from bisphenol A (F; m/z=135) at a position 100 nm from the surface of the toner particle.

Where the formula (3) is in the above range, it means that a large amount of the vinyl resin having a flexible ether structure is present on the surface of the toner particle as compared to the polyester resin having a rigid molecular structure.

That is, a large amount of soft resin is present on the toner particle surface, and as a result, the stress propagation effect can be enhanced. In addition, since a large amount of soft resin is present on the surface, it is possible to create a surface without fixing inhibition. As a consequence, the toner having both durability and fixing performance described above is likely to be obtained.

More specifically, where the formula (3) is satisfied, a flexible cross-linked structure derived from the vinyl resin having an ether structure is formed at a position 100 nm from the surface of the toner particle, and the surface of the toner particle is flexible and shows elastic behavior. Therefore, it is considered that the stress propagation effect is further enhanced.

Where the formula (3) is satisfied, dot reproducibility and durability are also further improved even when rough paper is used in a low-temperature and low-humidity environment.

This is thought to be due to the presence of a highly polar and flexible structure on the surface of the toner particle, so that an external force applied to the vicinity of the toner particle surface becomes uniform, the charge density distribution of the toner becomes uniform, and the charge distribution becomes sharp.

Further, it is considered that since the surface of the toner particle is flexible, minute cracks and internal strains on the surface can be suppressed even in a low-temperature and low-humidity environment, and satisfactory dot reproducibility is maintained throughout durability.

F/(D+E) is more preferably 1.00 or less, and further preferably 0.50 or less. Meanwhile, the lower limit is not particularly limited, and is preferably 0.00 or more, more preferably 0.01 or more. The F/(D+E) can be controlled, for example, by including, as a constituent component of the binder resin, a component derived from the crosslinking agent represented by a formula (4) or a formula (5) described hereinbelow, adjusting, as appropriate, the amount of the vinyl resin having the structure derived from the crosslinking agent and the amount of the structure derived from the crosslinking agent in the vinyl resin having the structure derived from the crosslinking agent, and the like.

The vinyl resin having an ether structure is preferably a resin including, as a constituent component, an alkylene glycol having an unsaturated double bond.

Further, the vinyl resin having an ether structure is preferably a resin having a crosslinked structure.

The cross-linked structure can be introduced by a method using a crystalline polyester having a polymerizable unsaturated group, or by using a polyfunctional monomer shown below, and these may be used in combination.

Where a cross-linked structure is introduced using a polyfunctional monomer, a vinyl polyfunctional monomer is preferable. Examples of the vinyl polyfunctional monomers include polyfunctional monomers of at least one kind selected from the group consisting of bifunctional monomers: polyalkylene glycol diacrylate, 1,6-hexanediol diacrylate, neopentyl glycol diacrylate, polyethylene glycol dimethacrylate, polypropylene glycol dimethacrylate, polytetramethylene glycol dimethacrylate 1,6-hexanediol dimethacrylate, neopentylglycol dimethacrylate, divinylbenzene, divinylnaphthalene, both-end acryl-modified silicone, and both-end methacryl-modified silicone; trifunctional monomers: trimethylolpropane triacrylate and trimethylolpropane trimethacrylate; tetrafunctional monomers: tetramethylol methane tetraacrylate and tetramethylol methane tetramethacrylate. Of these, bifunctional monomers are preferred.

Among these, it is preferable that the binder resin include the vinyl resin which has a monomer unit derived from the crosslinking agent shown by following formula (4).

The amount of the vinyl resin having a structure derived from the crosslinking agent in the binder resin is preferably from 80% by mass to 100% by mass.

It is preferable that the amount of the structure derived from the crosslinking agent in the vinyl resin having a structure derived from the crosslinking agent be 0.05% by mass to 5.0% by mass, and more preferably 0.09% by mass to 3.0% by mass.

(4)

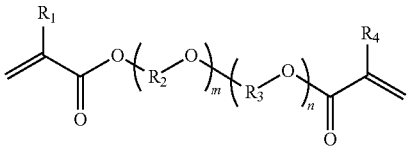

In the formula (4), m+n is an integer of 2 or more (preferably, an integer of from 2 to 25), $R_1$ and $R_4$ independently represent H or $CH_3$, and $R_2$ and $R_3$ independently represent a hydrocarbon group having a linear or branched chain and the hydrocarbon group has from 2 to 12 (preferably from 2 to 6) carbon atoms.

From the viewpoint of crosslinking reactivity and flexibility of the crosslinked structure, the molecular weight of the crosslinking agent is preferably from 200 to 2000, and more preferably from 300 to 1500.

When the binder resin includes a vinyl resin having a monomer unit derived from the crosslinking agent represented by the above formula (4), a flexible and elastic crosslinked structure can be formed in the vicinity of the toner particle surface. In addition, the stress propagation effect on the tough site is further enhanced.

As a result, the durability of the toner represented by the line width maintenance ratio in a high-temperature and high-humidity environment and the line width stability in a low-temperature and low-humidity environment is further improved without hindering the fixing performance.

Examples of the crosslinking agent satisfying the above formula (4) are shown below.

Polyethylene glycol #200 diacrylate (A200), polyethylene glycol #400 diacrylate (A400), polyethylene glycol #600 diacrylate (A600), polyethylene glycol #1000 diacrylate (A1000); and dipropylene glycol diacrylate (APG100), tripropylene glycol diacrylate (APG200), polypropylene glycol #400 diacrylate (APG400), polypropylene glycol #700 diacrylate (APG700), polytetrapropylene glycol #650 diacrylate (A-PTMG-65).

More preferably, the binder resin includes a vinyl resin having a monomer unit derived from a crosslinking agent represented by the following formula (5).

(5)

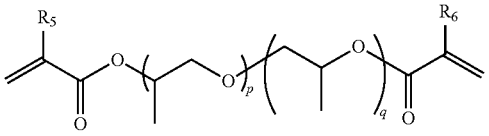

In the formula (5), p+q is an integer of 2 or more (preferably an integer of from 3 to 12), and $R_5$ and $R_6$ independently represent H or $CH_3$.

It is preferable that the binder resin include a vinyl resin having a monomer unit derived from the crosslinking agent represented by the above formula (5) because a flexible crosslinked structure is formed in the vicinity of the toner particle surface particularly easily as compared to other crosslinking agents having an ether structure.

This is presumably because the steric hindrance and the bendability of the main chain skeleton are enhanced by the branched structure of the alkylene moiety. Therefore, it is preferable because the rubbing fixing performance is improved.

In addition, since the alkylene moiety has a branched structure with respect to the polar ether group, the charging performance of the toner tends to be improved without excessively increasing the affinity with water.

Therefore, this is preferable because even when rough paper is used in a low-temperature and low-humidity environment, dot reproducibility and durability are improved.

Examples of the crosslinking agent that satisfies the above formula (5) are shown below.

Dipropylene glycol diacrylate (APG100), tripropylene glycol diacrylate (APG200), polypropylene glycol #400 diacrylate (APG400), and polypropylene glycol #700 diacrylate (APG700).

Examples of the external additive include metal oxide fine particles (inorganic fine particles) such as silica fine particles, alumina fine particles, titania fine particles, zinc oxide fine particles, strontium titanate fine particles, cerium oxide fine particles, and calcium carbonate fine particle. In addition, composite oxide fine particles using two or more kinds of metals can be used, or two or more kinds selected in any combination of these fine particle groups can be used.

Also, resin fine particles or organic-inorganic composite fine particles of resin fine particles and inorganic fine particles can be used.

More preferably, the external additive has at least one selected from the group consisting of silica fine particles and organic-inorganic composite fine particles.

Examples of the silica fine particles include sol-gel silica fine particles prepared by a sol-gel method, aqueous colloidal silica fine particles, alcoholic silica fine particles, fumed silica fine particles obtained by a gas phase method, and fused silica fine particles. Where the silica fine particles are non-spherical, the above-described effect is easily obtained.

Examples of resin particles include particles of resins such as vinyl resins, polyester resins, and silicone resins.

Organic-inorganic composite fine particles include organic-inorganic composite fine particles composed of resin fine particles and inorganic fine particles.

In the case of organic-inorganic composite fine particles, coalescence of toner particles is unlikely to be inhibited and fixing inhibition is unlikely to occur at the time of fixing due to the presence of the resin material component having a low heat capacity, while maintaining good durability and charging performance ensured by inorganic fine particles. For this reason, it is easy to achieve both durability and fixing performance.

The organic-inorganic composite fine particles are preferably composite fine particles having protruding portions composed of inorganic fine particles embedded in the surface of resin fine particles (preferably vinyl resin fine particles) which are the resin component. More preferred are composite fine particles having a structure in which inorganic fine particles are exposed on the surface of the vinyl resin particles. Composite fine particles having a structure having protruding portions derived from the inorganic fine particles on the surface of the vinyl resin fine particle are even more preferable.

Examples of the inorganic fine particles constituting the organic-inorganic composite fine particles include fine particles such as silica fine particles, alumina fine particles, titania fine particles, zinc oxide fine particles, strontium titanate fine particles, cerium oxide fine particles, calcium carbonate fine particles and the like.

The amount of the external additive is preferably from 0.1 parts by mass to 20.0 parts by mass with respect to 100 parts by mass of the toner particles.

The external additive may be hydrophobized with a hydrophobizing agent.

Examples of the hydrophobizing agent include chlorosilanes such as methyltrichlorosilane, dimethyldichlorosilane, trimethylchlorosilane, phenyltrichlorosilane, diphenyldichlorosilane, t-butyldimethylchlorosilane, vinyltrichlorosilane and the like;

alkoxysilanes such as tetramethoxysilane, methyltrimethoxysilane, dimethyldimethoxysilane, phenyltrimethoxysilane, diphenyldimethoxysilane, o-methylphenyltrimethoxysilane, p-methylphenyltrimethoxysilane, n-butyltrimethoxysilane, i-butyltrimethoxysilane, hexyltrimethoxysilane, octyltrimethoxysilane, decyltrimethoxysilane, dodecyltrimethoxysilane, tetraethoxysilane, methyltriethoxysilane, dimethyl diethoxysilane, phenyltriethoxysilane, diphenyldiethoxysilane, i-butyltriethoxysilane, decyltriethoxysilane, vinyltriethoxysilane, γ-methacryloxypropyltrimethoxysilane, γ-glycidoxypropyltrimethoxysilane, γ-glycidoxypropylmethyldimethoxysilane, γ-mercaptopropyltrimethoxysilane, γ-chloropropyltrimethoxysilane, γ-aminopropyltrimethoxysilane, γ-aminopropyltriethoxysilane, γ-(2-aminoethyl)aminopropyltrimethoxysilane, γ-(2-aminoethyl) aminopropylmethyldimethoxysilane and the like;

silazanes such as hexamethyldisilazane, hexaethyldisilazane, hexapropyldisilazane, hexabutyldisilazane, hexapentyldisilazane, hexahexyldisilazane, hexacyclohexyldisilazane, hexaphenyldisilazane, divinyltetramethyldisilazane, dimethyltetravinyldisilazane and the like;

silicone oils such as dimethyl silicone oil, methyl hydrogen silicone oil, methyl phenyl silicone oil, alkyl-modified silicone oils, chloroalkyl-modified silicone oils, chlorophenyl-modified silicone oils, fatty acid-modified silicone oils, polyether-modified silicone oils, alkoxy-modified silicone oils, carbinol-modified silicone oils, amino-modified silicone oils, fluorine-modified silicone oils, terminal reactive silicone oils and the like;

siloxanes such as hexamethylcyclotrisiloxane, octamethylcyclotetrasiloxane, decamethylcyclopentasiloxane, hexamethyldisiloxane, octamethyltrisiloxane and the like;

fatty acids and metal salts thereof such as long-chain fatty acids such as undecylic acid, lauric acid, tridecylic acid, dodecylic acid, myristic acid, palmitic acid, pentadecylic acid, stearic acid, heptadecylic acid, arachidic acid, montanic acid, oleic acid, linoleic acid, and arachidonic acid, and salts of the fatty acid and metals such as zinc, iron, magnesium, aluminum, calcium, sodium, lithium and the like.

Among these, alkoxysilanes, silazanes, and silicone oils are preferably used because they facilitate the hydrophobic treatment. These hydrophobic treatment agents may be used alone or in combination of two or more.

The toner may include a plurality of types of external additives in order to improve the flowability and charging performance of the toner.

In order to enhance the stress propagation effect, it is preferable to include an external additive having a number average particle diameter of primary particles of from 30 nm to 300 nm.

When the number average particle diameter of the primary particles of the external additive is 30 nm or more, embedding of the external additive is suppressed during long-term durability, and cracking of the toner particle surface is easily suppressed.

The reason therefor is that the local stress concentration is suppressed, and the stress is easily propagated to a tough site in the vicinity of the toner particle surface.

Further, when the number average particle diameter of the primary particles of the external additive is 300 nm or less, it is possible to suppress the transfer of the external additive to another toner particle or member at the time of durable output.

The number average particle diameter of primary particles of the external additive is more preferably from 50 nm to 200 nm.

The amount of the external additive having a number average particle diameter of the primary particles of from 30 nm to 300 nm is preferably from 0.05 parts by mass to 10.0 parts by mass with respect to 100 parts by mass of the toner particles.

Examples of the binder resin include the following.

Vinyl resin, styrene resin, styrene copolymer resin, polyester resin, polyol resin, polyvinyl chloride resin, phenol resin, natural resin-modified phenol resin, natural resin-modified maleic acid resin, acrylic resin, methacrylic resin, polyvinyl acetate, silicone resin, polyurethane resin, polyamide resin, furan resin, epoxy resin, xylene resin, polyvinyl butyral, terpene resin, coumarone indene resin, and petroleum resin.

Preferably, it is a styrene copolymer resin, a polyester resin, and a hybrid resin in which a polyester resin and a vinyl resin are mixed, or the two are partially reacted.

The toner particle may include a release agent.

Examples of the release agent include waxes mainly composed of fatty acid esters such as carnauba wax, montanic acid ester wax and the like; waxes obtained by partial or complete removal of an acid component from fatty acid esters, such as deacidified carnauba wax and the like; methyl ester compounds having a hydroxy group and obtained, e.g., by hydrogenation of vegetable oils and fats; saturated fatty acid monoesters such as stearyl stearate, behenyl behenate and the like; diesterified products of saturated aliphatic dicarboxylic acids and saturated aliphatic alcohols such as dibehenyl sebacate, distearyl dodecanedioate, distearyl dioctadecanedioate and the like; diesterified products of saturated aliphatic diols and saturated fatty acids such as nonanediol dibehenate, dodecanediol distearate and the like; aliphatic hydrocarbon waxes such as low-molecular-weight polyethylene, low-molecular-weight polypropylene, microcrystalline wax, paraffin wax, Fischer-Tropsch wax and the like; oxides of aliphatic hydrocarbon waxes such as oxidized polyethylene waxes, or block copolymers thereof; waxes obtained by grafting a vinyl monomer such as styrene, acrylic acid and the like onto aliphatic hydrocarbon waxes; saturated linear fatty acids such as palmitic acid, stearic acid, montanic acid and the like; unsaturated fatty acids such as brassic acid, eleostearic acid, parinaric acid and the like; saturated alcohols such as stearyl alcohol, aralkyl alcohol, behenyl alcohol, carnauvir alcohol, seryl alcohol, myricyl alcohol and the like; polyhydric alcohols such as sorbitol and the like; fatty acid amides such as linoleic acid amide, oleic acid amide, lauric acid amide and the like; saturated fatty acid bisamides such as methylene bisstearic acid amide, ethylene biscapric acid amide, ethylene bislauric acid amide, hexamethylene bisstearic acid amide and the like; unsaturated fatty acid amides such as ethylene bisoleic acid amide, hexamethylene bisoleic acid amide, N,N'-dioleyl adipic acid amide, N,N'-dioleyl sebacic acid amide and the like; aromatic bisamides such as m-xylene bisstearic acid amide, N,N'-distearyl isophthalic acid amide and the like; aliphatic metal salts (generally referred to as metal soap) such as calcium stearate, calcium laurate, zinc stearate, magnesium stearate and the like; long-chain alkyl alcohols or long-chain carboxylic acids having 12 or more carbon atoms; and the like.

Among these release agents, monofunctional or bifunctional ester waxes such as saturated fatty acid monoesters, diesterified products and the like, and hydrocarbon waxes such as paraffin waxes, and Fischer-Tropsch waxes and the like are preferable.

Also, the melting point of the release agent defined by the peak temperature of the maximum endothermic peak at the time of temperature rise which is measured by a differential scanning calorimeter (DSC) is preferably 60° C. to 140° C., and more preferably 60° C. to 90° C. When the melting point is 60° C. or higher, the storage stability of the toner is improved. Meanwhile, when the melting point is 140° C. or lower, the low-temperature fixing performance is easily improved.

The amount of the release agent is preferably from 3 parts by mass to 40 parts by mass with respect to 100 parts by mass of the binder resin.

The toner particle may include a charge control agent.

Organometallic complex compounds and chelate compounds are effective as charge control agents for negative charging and can be exemplified by monoazo metal complex compounds; acetylacetone metal complex compounds; metal complexes of aromatic hydroxycarboxylic acids or aromatic dicarboxylic acids, and the like.

Specific examples of commercially available products, include Spilon Black TRH, T-77, T-95 (Hodogaya Chemical Co., Ltd.), BONTRON (registered trademark) S-34, S-44, S-54, E-84, E-88, E-89 (Orient Chemical Co., Ltd.).

These charge control agents can be used alone or in combination of two or more. From the viewpoint of charge quantity of the toner, the amount of the charge control agent used is preferably from 0.1 parts by mass to 10.0 parts by mass, and more preferably from 0.1 parts by mass to 5.0 parts by mass with respect to 100 parts by mass of the binder resin.

The toner particle may include a colorant. A conventionally well-known colorant can be used. The toner can be used as any one of magnetic one-component toner, non-magnetic one-component toner, and non-magnetic two-component toner.

As the colorant used when the toner is a non-magnetic toner, a black colorant such as carbon black, grafted carbon, or a colorant adjusted to black by using the following yellow, magenta, and cyan colorants can be used.

Examples of yellow colorants include compounds typified by condensed azo compounds, isoindolinone compounds, anthraquinone compounds, azo metal complexes, methine compounds, and allylamide compounds.

Examples of magenta colorants include condensed azo compounds, diketopyrrolopyrrole compounds, anthraquinone compounds, quinacridone compounds, basic dye lake compounds, naphthol compounds, benzimidazolone compounds, thioindigo compounds, perylene compounds and the like.

Examples of cyan colorants include copper phthalocyanine compounds and derivatives thereof, anthraquinone compounds, basic dye lake compounds and the like. These colorants can be used alone, as a mixture, or in the form of a solid solution.

The amount of the colorant (other than the magnetic body) is preferably from 1 part by mass to 20 parts by mass, and more preferably from 2 parts by mass to 15 parts by mass with respect to 100 parts by mass of the binder resin.

When the toner is used as a magnetic one-component toner, a magnetic body is preferably used as the colorant.

Examples of the magnetic body to be included in the magnetic one-component toner include magnetic iron oxides such as magnetite, maghemite, and ferrite, and magnetic iron oxides including other metal oxides; metals such as Fe, Co, and Ni; alloys of these metals with metals such as Al, Co, Cu, Pb, Mg, Ni, Sn, Zn, Sb, Be, Bi, Cd, Ca, Mn, Se, Ti, W, and V, and mixtures thereof. When the magnetic body is included in the toner, it is preferable that the magnetic body be imparted with a function of an inorganic fine particle so as to serve as a tough site in the vicinity of the toner particle surface.

Among these, magnetite is preferable, and the shape thereof may be polyhedron, octahedron, hexahedron, spherical shape, needle shape, flake shape, and the like, but less anisotropic shape such as polyhedron, octahedron, hexahedron, spherical shape, and the like is preferable from the standpoint of increasing the image density.

The number average particle diameter of the primary particles of the magnetic body is preferably from 50 nm to 500 nm, and more preferably from 50 nm to 300 nm or less.

The number average particle diameter of the primary particles of the magnetic body present in the toner particle can be measured using a transmission electron microscope.

Specifically, the toner particles to be observed are sufficiently dispersed in an epoxy resin and then curing is performed in an atmosphere at a temperature of 40° C. for 2 days to obtain a cured product. A flaky sample is obtained from the obtained cured product with a microtome, an image with a magnification of 10,000 to 40,000 times is captured with a transmission electron microscope (TEM), and the projected area of 100 primary particles of the magnetic body in the image is measured. The equivalent diameter of a circle equal to the projected area is defined as the particle diameter of the primary particles of the magnetic body, and the average value for the 100 particles is defined as the number average particle diameter of the primary particles of the magnetic body.

The amount of the magnetic body is preferably from 20 parts by mass to 100 parts by mass, and more preferably from 25 parts by mass to 90 parts by mass with respect to 100 parts by mass of the binder resin.

The amount of the magnetic body in the toner can be measured using a thermal analyzer TGA Q5000IR manufactured by PerkinElmer, Inc. In the measurement method, the toner is heated from normal temperature to 900° C. at a temperature rising rate of 25° C./min in a nitrogen atmosphere, the weight loss in the range of 100° C. to 750° C. is defined as the mass of the toner components other than the magnetic body, and the remaining mass is taken as the amount of magnetic body.

A method for manufacturing the magnetic body can be exemplified by the following method.

An aqueous solution including ferrous hydroxide is prepared by adding an alkali such as sodium hydroxide or the like in an amount equivalent to or greater than the iron component to a ferrous salt aqueous solution. Air is blown in while maintaining the pH of the prepared aqueous solution at pH 7 or higher, and ferrous hydroxide is oxidized while the aqueous solution is heated to 70° C. or higher to first produce seed crystals for the cores of the magnetic body.

Next, an aqueous solution including 1 equivalent of ferrous sulfate, based on the amount of the alkali added previously, is added to the slurry-like liquid including seed crystals. While maintaining the pH of the solution at 5 to 10 and blowing air, the reaction of ferrous hydroxide is advanced to grow magnetic iron oxide particles with the seed crystals as the cores. At this time, it is possible to control the shape and magnetic characteristics of the magnetic body by selecting at random pH, reaction temperature, and stirring conditions. As the oxidation reaction proceeds, the pH of the liquid shifts to the acidic side, but the pH of the liquid is preferably not less than 5. The magnetic body can be obtained by using conventional methods for filtering, washing, and drying the magnetic iron oxide particles which were thus obtained.

Further, when the toner is produced by a polymerization method, it is preferable to subject the surface of the magnetic body to a hydrophobic treatment. When the surface treatment is performed by a dry method, the coupling agent treatment can be performed on the surface of the magnetic body that have been washed, filtered, and dried. In the case of wet surface treatment, after the oxidation reaction is completed, the dried material is redispersed, or after completion of the oxidation reaction, the magnetic iron oxide particles obtained by washing and filtering can be redispersed, without drying, in another aqueous medium to perform a coupling treatment.

Specifically, the coupling treatment can be performed by adding a silane coupling agent while sufficiently stirring the redispersed liquid and raising the temperature after hydrolysis, or by adjusting the pH of the dispersion liquid to an alkaline region after hydrolysis. Among these, from the viewpoint of performing a uniform surface treatment, it is preferable to carry out the surface treatment by reslurrying as it is, without drying, after filtration and washing after completion of the oxidation reaction.

To perform wet surface treatment of the magnetic body, that is, the treatment with a coupling agent in an aqueous medium, the magnetic body is first sufficiently dispersed in the aqueous medium to obtain a primary particle diameter, and stirred with a stirring blade or the like to prevent sedimentation and aggregation. Next, an arbitrary amount of the coupling agent is added to the dispersion liquid, and the surface treatment is performed while the coupling agent is hydrolyzed. At this time, it is more preferable to perform the surface treatment while ensuring sufficient dispersion to prevent aggregation by using a device such as a pin mill or a line mill while stirring.

Here, the aqueous medium is a medium including water as a main component. Specific examples include water itself, water added with a small amount of surfactant, water added with a pH adjusting agent, and water added with an organic solvent. As the surfactant, nonionic surfactants such as polyvinyl alcohol are preferable. The surfactant is preferably added in an amount of 0.1% by mass to 5.0% by mass in the aqueous medium. Examples of the pH adjusting agent include inorganic acids such as hydrochloric acid. Examples of the organic solvent include alcohols.

Examples of the coupling agent that can be used in the surface treatment of the magnetic body include a silane coupling agent, a titanium coupling agent and the like. It is more preferable that a silane coupling agent represented by a following formula (I) be used.

$$R_mSiY_n \quad (I)$$

In the formula (I), R represents an alkoxy group (preferably having 1 to 3 carbon atoms), m represents an integer of 1 to 3, Y represents a functional group such as an alkyl group (preferably having 2 to 20 carbon atoms), a phenyl group, a vinyl group, an epoxy group, an acryl group, or a methacryl group, and n represents an integer of 1 to 3. However, m+n=4.

Examples of the silane coupling agent represented by the formula (I) include vinyltrimethoxysilane, vinyltriethoxysilane, vinyltris(β-methoxyethoxy)silane, β(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyl triacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane, n-octadecyltrimethoxysilane and the like.

Among these, from the viewpoint of imparting high hydrophobicity to the magnetic body, it is preferable to use an alkyltrialkoxysilane coupling agent represented by the following formula (II).

$$C_pH_{2p+1}—Si—(OC_qH_{2q+1})_3 \quad (II)$$

In the formula (II), p represents an integer of 2 to 20, and q represents an integer of 1 to 3.

When p in the above formula is 2 or more, the magnetic body can be made sufficiently hydrophobic. When p is 20 or less, the hydrophobicity is sufficient, and the coalescence of the magnetic body can be suppressed. Furthermore, when q is 3 or less, the reactivity of the silane coupling agent is satisfactory and hydrophobization is likely to be sufficiently performed.

Therefore, it is preferable to use an alkyltrialkoxysilane coupling agent in which p in the formula represents an integer of 2 to 20 (more preferably, an integer of 3 to 15) and q represents an integer of 1 to 3 (more preferably 1 or 2).

The silane coupling agents can be used alone or in combination of a plurality thereof for the treatment. When a plurality of coupling agents is used in combination, the treatment may be performed with each coupling agent individually or simultaneously.

The total treatment amount of the coupling agent to be used is preferably 0.9 parts by mass to 3.0 parts by mass with respect to 100 parts by mass of the magnetic body, and it is preferable to adjust the amount of the treatment agent according to the surface area of the magnetic body, the reactivity of the coupling agent and the like.

Hereinafter, a toner production method will be exemplified, but the present invention is not limited thereto.

In the present invention, the surface presence ratio of the magnetic body obtained by image analysis of the toner particle surface with a scanning electron microscope at an accelerating voltage of 5.0 kV is preferably from 10% to 70%.

There are no particular limitations on the production method for setting the surface presence ratio of the magnetic body to from 10% to 70%, but a method for producing toner particles in an aqueous medium, such as a dispersion polymerization method, an association aggregation method, a dissolution suspension method, a suspension polymerization method, an emulsion aggregation method, and the like, is preferable.

The suspension polymerization method is more preferable because the magnetic body can be easily caused to be present in the vicinity of the toner particle surface and a toner satisfying suitable physical properties of the present invention is easily obtained.

In the suspension polymerization method, for example, a polymerizable monomer that can form a binder resin, and, if necessary, a magnetic body, a polymerization initiator, a crosslinking agent, a charge control agent, and other additives are uniformly dispersed to obtain a polymerizable monomer composition. Thereafter, the obtained polymerizable monomer composition is dispersed and granulated in a continuous layer (for example, an aqueous phase) including a dispersion stabilizer by using an appropriate stirrer, and polymerized using the polymerization initiator to obtain toner particles having a desired particle diameter.

The toner obtained by this suspension polymerization method is hereinafter also referred to as "polymerized toner".

Examples of the polymerizable monomer include the following.

Styrenic monomers such as styrene, o-methylstyrene, m-methylstyrene, p-methylstyrene, p-methoxystyrene, p-ethylstyrene and the like.

Acrylic acid esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, phenyl acrylate and the like.

Methacrylic acid esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, diethylaminoethyl methacrylate and the like.

Other monomers such as acrylonitrile, methacrylonitrile, acrylamide and the like. These monomers can be used alone or in combination.

Among the above-mentioned monomers, it is preferable that a styrenic monomer alone or in combination with other monomers such as acrylic acid esters, methacrylic acid esters and the like be used because the toner structure can be controlled and the toner development properties and durability are easily improved. In particular, it is more preferable to use styrene and an acrylic acid alkyl ester or styrene and a methacrylic acid alkyl ester as main components. That is, the binder resin preferably includes 50% by mass or more of styrene acrylic resin.

As the polymerization initiator to be used in the production of toner particles by a polymerization method, those having a half-life of from 0.5 h to 30 h during the polymerization reaction are preferable. Moreover, it is preferable to use the polymerization initiator with the addition amount of from 0.5 parts by mass to 20 mass by mass with respect to 100 mass parts of the polymerizable monomers. As a result, a polymer having a maximum molecular weight between 5,000 and 50,000 can be obtained, and the toner can be provided with preferable strength and appropriate melting characteristics.

Specific examples of the polymerization initiator include azo- or diazo-based polymerization initiators such as 2,2'-azobis-(2,4-dimethylvaleronitrile), 2,2'-azobisisobutyronitrile, 1,1'-azobis (cyclohexane-1-carbohynitrile), 2,2'-azobis-4-methoxy-2,4-dimethylvaleronitrile, azobisisobutyronitrile and the like; and peroxide-based polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butylperoxy 2-ethylhexanoate, t-butylperoxypivalate, di(2-ethylhexyl) peroxydicarbonate, di(secondary butyl) peroxydicarbonate and the like.

Of these, t-butyl peroxypivalate is preferable.

Where the toner is produced by a polymerization method, a crosslinking agent may be added.

The addition amount is preferably from 0.05 parts by mass to 15 parts by mass, more preferably from 0.10 parts by mass to 10.0 parts by mass, and even more preferably from 0.20 parts by mass to 5.0 parts by mass with respect to 100 parts by mass of the polymerizable monomer.

From the viewpoint of easily obtaining a stress propagation effect, the crosslinking agent preferably has the ether structure described above, and preferably does not include a structure having high rigidity such as an aromatic hydrocarbon group such as a phenylene group.

The addition amount of the crosslinking agent is preferably from 0.05 parts by mass to 15.00 parts by mass, more preferably 0.10 parts by mass to 3.00 parts by mass, and even more preferably from 0.20 parts by mass to 2.50 parts by mass with respect to 100 parts by mass of the polymerizable monomer.

The above polymerizable monomer composition may include a polar resin.

Examples of polar resins include homopolymers of styrene and substituted products thereof such as polystyrene, polyvinyltoluene and the like; styrene copolymers such as styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, styrene-maleic acid ester copolymer and the like; polymethyl methacrylate, polybutyl methacrylate, polyvinyl acetate, polyethylene, polypropylene, polyvinyl butyral, silicone resin, polyester resin, styrene-polyester copolymer, polyacrylate-polyester copolymer, polymethacrylate-polyester copolymer, polyamide resin, epoxy resin, polyacrylic acid resin, terpene resin, phenol resin, and the like.

These can be used alone or in admixture of two or more. Moreover, a functional group such as an amino group, a carboxy group, a hydroxyl group, a sulfonic acid group, a glycidyl group, a nitrile group and the like may be introduced in these polymers. Among these resins, polyester resins are preferable.

As the polyester resin, a saturated polyester resin, an unsaturated polyester resin, or both can be appropriately selected and used.

As the polyester resin, a normal resin composed of an alcohol component and an acid component can be used. The two components are exemplified below.

Examples of the dihydric alcohol component include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexanedimethanol, butenediol, octenediol, cyclohexenedimethanol, hydrogenated bisphenol A, or a bisphenol derivative represented by a following formula (A); a hydrogenation product of the compound represented by the formula (A), a diol represented by a following formula (B), or a hydrogenation product of the compound represented by the formula (B).

(A)

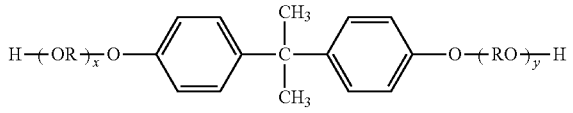

In the formula (A), R is an ethylene group or a propylene group, x and y are each an integer of 1 or more, and the average value of x+y is 2 to 10.

(B)

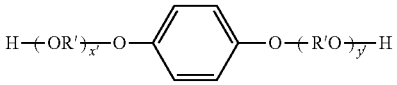

In the formula, R' is

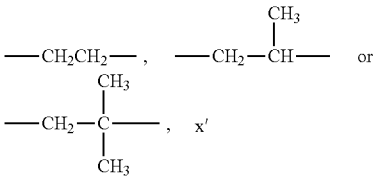

and y' are each an integer of 0 or more, and the average value of x'+y' is 0 to 10.

As the divalent alcohol component, an alkylene oxide adduct of bisphenol A, which is excellent in charging characteristics and environmental stability and balanced in other electrophotographic characteristics, is particularly preferable.

In the case of this compound, the average added mole number of alkylene oxide is preferably from 2 to 10 or less from the viewpoint of fixing performance and toner durability.

Examples of the divalent acid component include benzene dicarboxylic acids such as phthalic acid, terephthalic acid, isophthalic acid, phthalic anhydride and anhydrides thereof; alkyl dicarboxylic acid such as succinic acid, adipic acid, sebacic acid, azelaic acid and anhydrides thereof; succinic acids substituted with an alkyl or alkenyl group having 6 to 18 carbon atoms, and anhydrides thereof; unsaturated dicarboxylic acids such as fumaric acid, maleic acid, citraconic acid, itaconic acid and anhydrides thereof.

Furthermore, examples of the trihydric or higher alcohol component include glycerin, pentaerythritol, sorbit, sorbitan, and oxyalkylene ethers of novolac type phenol resins. Examples of the trivalent or higher acid component include trimellitic acid, pyromellitic acid, 1,2,3,4-butanetetracarboxylic acid, benzophenone tetracarboxylic acid, anhydrides thereof and the like.

The polyester resin preferably includes from 45 mol % to 55 mol % of the alcohol component when the total of the alcohol component and the acid component is taken as 100 mol %.

The polyester resin can be produced using any catalyst such as a tin-based catalyst, an antimony-based catalyst, and a titanium-based catalyst, but a titanium-based catalyst is preferably used.

Further, from the viewpoint of developing performance, blocking resistance and durability, the polar resin preferably has a number average molecular weight of from 2,500 to 25,000.

The acid value of the polar resin is preferably from 1.0 mg KOH/g to 15.0 mg KOH/g, and more preferably from 2.0 mg KOH/g to 10.0 mg KOH/g.

The amount of the polar resin is preferably from 2 parts by mass to 20 parts by mass with respect to 100 parts by mass of the binder resin.

A dispersion stabilizer may be included in the aqueous medium in which the polymerizable monomer composition is dispersed.

As the dispersion stabilizer, known surfactants, organic dispersing agents, and inorganic dispersing agents can be used.

Among these, inorganic dispersing agents can be preferably used because they ensure dispersion stability due to the steric hindrance thereof, so that the stability is not easily lost even when the reaction temperature is changed, and are easily washed and do not adversely affect the toner.

Specific examples of inorganic dispersing agents include polyvalent metal salts of phosphoric acid such as tricalcium phosphate, magnesium phosphate, aluminum phosphate, zinc phosphate, hydroxyapatite and the like, carbonates such as calcium carbonate, magnesium carbonate and the like, inorganic salts such as calcium metasilicate, calcium sulfate, barium sulfate and the like, and inorganic compounds such as calcium hydroxide, magnesium hydroxide, aluminum hydroxide and the like.

The addition amount of the inorganic dispersing agent is preferably from 0.2 parts by mass to 20 parts by mass with respect to 100 parts by mass of the polymerizable monomer. Moreover, a dispersion stabilizer may be used independently and a plurality of kinds thereof may be used together. Furthermore, from 0.001 mass part to 0.1 mass part of a surfactant may be used in combination.

In the case of using an inorganic dispersing agent, the dispersing agent may be used as it is, but in order to obtain finer particles, fine particles of the inorganic dispersing agent can be generated and used in an aqueous medium.

For example, in the case of tricalcium phosphate, a sodium phosphate aqueous solution and a calcium chloride aqueous solution can be mixed under high-speed stirring to produce water-insoluble calcium phosphate fine particles, which enables more uniform and fine dispersion.

Examples of the surfactant include sodium dodecylbenzene sulfate, sodium tetradecyl sulfate, sodium pentadecyl sulfate, sodium octyl sulfate, sodium oleate, sodium laurate, sodium stearate, potassium stearate and the like.

In the step of polymerizing the polymerizable monomer, the polymerization temperature may be set usually 40° C. or higher, preferably from 50° C. to 90° C. Where the polymerization is performed in this temperature range, for example, a release agent or the like that is to be sealed inside is precipitated by phase separation, and the encapsulation becomes more complete.

Thereafter, a cooling step of cooling from a reaction temperature of about 50° C. to 90° C. is performed to finish the polymerization reaction step. At that time, gradual cooling may be performed so as to maintain a compatible state of the release agent and the binder resin.

After completion of the polymerization of the polymerizable monomer, toner particles are obtained by filtering, washing, and drying the obtained polymer particles by a known method. A toner can be obtained by mixing the toner particles with an external additive and adhering the external additive to the surface of the toner particles. It is also possible to add a classification step to the production process to cut coarse powder and fine powder contained in the toner particles.

Methods for measuring various physical properties of the toner of the present invention will be described below.

Method for Measuring Number Average Particle Diameter of Primary Particles of External Additive The number average particle diameter of primary particles of the external additive is measured using a scanning electron microscope "S-4800" (trade name; manufactured by Hitachi, Ltd.). The toner to which the external additive has been externally added is observed, and the major axis of 100 randomly selected primary particles of the external additive is measured in the field of view enlarged up to 50,000 times to obtain the number average particle diameter. The observation magnification is appropriately adjusted according to the size of the external additive.

In addition, when the external additive can be obtained independently, the external additive can also be measured independently by the above method.

Method for Measuring Number Average Particle Diameter of Primary Particles of Magnetic Body The number average particle diameter of the primary particles of the magnetic body may be measured using the scanning electron microscope "S-4800" (trade name; manufactured by Hitachi, Ltd.). For example, when a magnetic body is externally added, the number average particle diameter is determined by observing the toner and measuring the major axis of 100 randomly selected primary particles of the magnetic body in a field of view enlarged up to 50,000 times. The observation magnification is appropriately adjusted according to the size of the magnetic body. In addition, when magnetic body can be obtained independently, the magnetic body may also be measured independently by the above method.

Method for Measuring Surface Presence Ratio of Magnetic Body

The surface presence ratio of the magnetic body is measured by separating the external additive from the toner to which the external additive has been added.

A total of 1 g of toner is suspended in 20 mL of methanol and subjected to ultrasonic treatment for 30 min using an ultrasonic disperser SC-103 (manufactured by SMT Co., Ltd.), the external additive is detached from the toner particles, and the toner is allowed to stand for 24 h. The precipitated toner particles and the external additive dispersed in the supernatant liquid are separated, collected, and dried at 50° C. for 24 h to isolate the toner particles.

A total of 50 randomly selected toner particles are observed at an accelerating voltage of 5.0 kV with a scanning electron microscope "S-4800" in the field of view enlarged at 10,000 times.

The surface presence ratio of the magnetic body is calculated from the observed image in the following manner by using the image processing software "ImageJ" (available from https://imagej.nih.gov/ij/).

The observed image is binarized by selecting "Image-Adjust-Threshold" and setting a threshold in the displayed dialog box so that all toner particles are extracted.

The same image is binarized by the same procedure by changing only the threshold so that only magnetic body is extracted. For each image, the number of pixels of brightness values corresponding to all toner particles and magnetic body is obtained from "Analyze-Histogram", and the respective areas are calculated. The surface presence ratio of the magnetic body is calculated from the obtained area by using the following formula.

(Formula) Total area of magnetic body/total area of toner particles×100

The surface presence ratio of the magnetic body is calculated for all the observed toner particles, and the arithmetic average value thereof is used.

Method for Measuring Hardness by Nanoindentation Method

The toner hardness is measured by the nanoindentation method by using Picodenter HM500 manufactured by Fisher Instrument Co., Ltd. The software WIN-HCU provided with the device is used. A Vickers indenter (angle: 130°) is used as the indenter.

The measurement includes a step of pushing the indenter till a predetermined load is obtained for a predetermined time (hereinafter referred to as "indentation step"). In this measurement, the load application speed is changed by changing the set time and load.

First, a microscope displayed on the software is focused on a video camera screen connected to the microscope. Then, a glass plate (hardness: 3600 N/mm$^2$) for performing the Z-axis alignment described hereinbelow is used for the target object for focusing. At this time, the objective lens is sequentially focused from 5× to 20× and 50×. Thereafter, adjustment is performed with a 50× objective lens.

Next, the "Approach Parameter Setting" operation is performed using the glass plate that has been focused as described above, and the Z-axis alignment of the indenter is performed. Thereafter, the glass plate is replaced with an acrylic plate, and a "Cleaning of Indenter" operation is performed. The "Cleaning of Indenter" operation means that the tip of the indenter is wiped with a cotton swab moistened with ethanol, and at the same time, the indenter position designated on the software is matched with the indenter position on the hardware, that is, the operation of XY-axis alignment of the indenter is performed.

After that, the acrylic plate is changed to a slide glass to which the toner has been attached, and the microscope is focused on the toner to be measured. The method for attaching the toner to the slide glass is as follows.

First, the toner to be measured is attached to the tip of a cotton swab, and excess toner is screened off with the edge of a bottle. Thereafter, the toner attached to the swab is tapped off onto the slide glass so as to form a toner monolayer while pressing the swab shaft against the edge of the slide glass.

After that, the slide glass to which the toner monolayer has been attached as described hereinabove is set on the microscope, the microscope is focused on the toner with a 50× objective lens, and the indenter tip is set, on the software, to arrive at the center of the toner particle. The toner to be selected is limited to particles having a weight average particle diameter D4 (μm)±1.0 μm of both the major axis and the minor axis.

The measurement is performed by carrying out the indentation step under the following conditions.

Indentation Step 1

Maximum indentation load=0.25 mN

Indentation time=300 sec

The load application speed of 0.83 μN/sec can be set by the above conditions.

Indentation Step 2
Maximum indentation load=0.50 mN
Indentation time=200 sec

The load application speed of 2.5 μN/sec can be set by the above conditions.

Slopes determined by linear approximation by the least square method of data in a displacement region of from 0.00 μm to 0.20 μm from a load-displacement curve obtained in these two indentation steps where a load a (mN) is plotted against the ordinate and a displacement amount b (μm) is plotted against the abscissa are taken as toner hardness A and B. The displacement value at which a positive load is measured for the first time is defined as the initial displacement value (0.00 μm). Further, data in a section of from 0.00 μm to 0.20 are collected for 100 points or more.

The above measurement is performed on 30 toner particles, and an arithmetic average value is used.

In the measurement, the above-described "Cleaning of Indenter" operation (including XY-axis alignment of the indenter) is necessarily performed for each particle measurement.

Regarding the toner hardness C, a toner hardness (N/m) is plotted against the ordinate, a load application speed (μN/sec) is plotted against the abscissa, a segment of a straight line passing through the toner hardness A and the toner hardness B is obtained, and a value (N/m) of C at a point of time at which the load application speed is 0.00 μN/sec is obtained as the toner hardness C (N/m).

Method for Measuring Degree of Uneven Surface Distribution of Magnetic Body

A method for measuring the degree of uneven surface distribution of magnetic body in the cross section of a toner particle observed with a transmission electron microscope (TEM) is as follows.

First, the toner to be observed is thoroughly dispersed in an epoxy resin curable at a normal temperature.

Thereafter, the cured product obtained by curing in an atmosphere at a temperature of 40° C. for 2 days is observed as a flaky sample obtained by cutting, as it is or after freezing, with a microtome equipped with diamond teeth. For the cross section of the toner particle to be observed, the circle-equivalent diameter (projected area circle-equivalent diameter) is obtained from the projected area of the cross section in the TEM image, and the value thereof is included in the width of ±10% of the number average particle diameter (D1) (μm) of the toner.

For 100 such particles, the total number of the magnetic body present from the contour of the cross section to a distance 0.15 times the projected area circle-equivalent diameter of the cross-section (magnetic body which had parts at a distance more than 0.15 times from the contour of the cross section are also counted) is divided by the number of all magnetic bodies present in the 100 cross sections to obtain the degree of uneven surface distribution (number %).

In the present invention, a transmission electron microscope (model H-600, manufactured by Hitachi, Ltd.) is used, observation is performed at an accelerating voltage of 100 kV, and measurement is performed using a micrograph obtained at a magnification of 10,000 times.

The magnetic body is binarized from the observed image by using image processing software "ImageJ" (available from https://imagej.nih.gov/ij/) as follows.

The image observed at this time is binarized by selecting "Image-Adjust-Threshold", and setting a threshold in the displayed dialog box so that the entire cross section of the toner particle is extracted. The same image is binarized by the same procedure by changing only the threshold so that only magnetic body is extracted.

Measurement of Particle Diameter of Toner (Particle)

A precision particle size distribution measuring device (trade name:

Coulter Counter Multisizer 3) based on a pore electric resistance method and dedicated software (trade name: Beckman Coulter Multisizer 3, Version 3.51, manufactured by Beckman Coulter, Inc.) are used.

The aperture diameter is 100 μm, the measurement is performed with 25,000 effective measurement channels, and the measurement data are analyzed and calculated. For example, "ISOTON II" (trade name) manufactured by Beckman Coulter, Inc., which is a solution prepared by dissolving special grade sodium chloride in ion exchanged water to a concentration of about 1% by mass, can be used as the electrolytic aqueous solution for measurements. The dedicated software is set up in the following manner before the measurement and analysis.

The total count number in a control mode is set to 50,000 particles on a "CHANGE STANDARD MEASUREMENT METHOD (SOM) SCREEN" of the dedicated software, the number of measurements is set to 1, and a value obtained using (standard particles 10.0 μm, manufactured by Beckman Coulter, Inc.) is set as a Kd value. The threshold and the noise level are automatically set by pressing a measurement button of threshold/noise level. Further, the current is set to 1600 μA, the gain is set to 2, the electrolytic solution is set to ISOTON II (trade name), and flush of aperture tube after measurement is checked.

In the "PULSE TO PARTICLE DIAMETER CONVERSION SETTING SCREEN" of the dedicated software, the bin interval is set to a logarithmic particle diameter, the particle diameter bin is set to a 256-particle diameter bin, and a particle diameter range is set from 2 μm to 60 μm.

The specific measurement method is described hereinbelow.

(1) Approximately 200 mL of the electrolytic aqueous solution is placed in a dedicated glass 250 mL round-bottom beaker of Multisizer 3, the beaker is set in a sample stand, and stirring with a stirrer rod is carried out counterclockwise at 24 revolutions per second. Dirt and air bubbles in the aperture tube are removed by the "FLUSH OF APERTURE TUBE" function of the dedicated software.

(2) About 30 mL of the electrolytic aqueous solution is placed in a glass 100 mL flat-bottom beaker. Then, about 0.3 mL of a diluted solution obtained by 3-fold mass dilution of "CONTAMINON N" (trade name) (10% by mass aqueous solution of a neutral detergent for washing precision measuring instruments, manufactured by Wako Pure Chemical Industries, Ltd.) with ion exchanged water is added thereto.

(3) A predetermined amount of ion exchanged water and about 2 mL of the CONTAMINON N (trade name) are added in the water tank of an ultrasonic disperser (trade name: Ultrasonic Dispersion System Tetora 150, manufactured by Nikkaki Bios Co., Ltd.) with an electrical output of 120 W in which two oscillators with an oscillation frequency of 50 kHz are built in with a phase shift of 180 degrees.

(4) The beaker of (2) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) About 10 mg of the toner (particles) is added little by little to the electrolytic aqueous solution and dispersed therein in a state in which the electrolytic aqueous solution in the beaker of (4) hereinabove is irradiated with ultrasonic waves. Then, the ultrasonic dispersion process is further continued for 60 sec. In the ultrasonic dispersion, the water temperature in the water tank is appropriately adjusted to a temperature of from 10° C. to 40° C.

(6) The electrolytic aqueous solution of (5) hereinabove in which the toner (particles) is dispersed is dropped using a pipette into the round bottom beaker of (1) hereinabove which is set in the sample stand, and the measurement concentration is adjusted to be about 5%. Then, measurement is conducted until the number of particles to be measured reaches 50,000.

(7) The measurement data are analyzed with the dedicated software provided with the apparatus, and the weight average particle diameter (D4) and the number average particle diameter (D1) are calculated. The "AVERAGE DIAMETER" on the "ANALYSIS/VOLUME STATISTICAL VALUE (ARITHMETIC MEAN)" screen when the dedicated software is set to graph/volume % is the weight average particle diameter (D4). The "AVERAGE DIAMETER" on the "ANALYSIS/NUMBER STATISTICAL VALUE (ARITHMETIC MEAN)" screen when the dedicated software is set to graph/number % is the number average particle diameter (D1).

Method for Measuring Weight Average Molecular Weight (Mw) and Peak Molecular Weight (Mp) of Resin, etc.

The weight average molecular weight (Mw) and peak molecular weight (Mp) of the resin and the other materials are measured using gel permeation chromatography (GPC) in the following manner.

(1) Preparation of Measurement Sample

A sample and tetrahydrofuran (THF) are mixed at a concentration of 5.0 mg/mL. The mixture is allowed to stand at room temperature for 5 h to 6 h and then shaken thoroughly, and the sample and THF are mixed well till the sample aggregates are loosened. The components are thereafter further allowed to stand for 12 h or more at room temperature. At this time, the time from the start of mixing of the sample and THF to the end of standing is set to be 72 h or more to obtain tetrahydrofuran (THF) soluble matter of the sample.

Subsequent filtration through a solvent-resistant membrane filter (pore size: 0.45 μm to 0.50 μm, Myshory Disc H-25-2 (manufactured by Tosoh Corporation)) produces a sample solution.

(2) Measurement of Sample

Measurement is performed under the following conditions using the obtained sample solution.

Device: high-speed GPC device LC-GPC 150C (manufactured by Waters Co.)

Column: 7 series of Shodex GPC KF-801, 802, 803, 804, 805, 806, 807 (manufactured by Showa Denko K.K.)

Mobile phase: THF

Flow rate: 1.0 mL/min

Column temperature: 40° C.

Sample injection volume: 100 μL

Detector: RI (refractive index) detector

When measuring the molecular weight of the sample, the molecular weight distribution of the sample is calculated from the relationship between the logarithmic value of the calibration curve prepared using several types of monodispersed polystyrene standard samples and the count number.

Samples produced by Pressure Chemical Co. or Toyo Soda Industry Co., Ltd. and having a molecular weight of $6.0\times10^2$, $2.1\times10^3$, $4.0\times10^3$, $1.75\times10^4$, $5.1\times10^4$, $1.1\times10^5$, $3.9\times10^5$, $8.6\times10^5$, $2.0\times10^6$, and $4.48\times10^6$ are used as standard polystyrene samples for preparation of the calibration curve.

Method for Measuring Secondary Ion Mass/Secondary Ion Charge Number (m/z) by Time-of-Flight Secondary Ion Mass Spectrometry (TOF-SIMS)

For measurement of peak intensity using TOF-SIMS, TRIFT-IV manufactured by ULVAC-PHI is used. The analysis conditions are as follows.

Sample preparation: the toner is attached to an indium sheet

Sample pretreatment: none

Primary ion: Au ion

Accelerating voltage: 30 kV

Charge neutralization mode: On

Measurement mode: Positive

Raster: 200 μm

Measurement time: 60 s

Calculation of peak intensity: according to ULVAC-PHI standard software (Win Cadense), the total count number at a mass number of 43.5 to 44.5 is taken as the peak intensity at (m/z) 44.

Similarly, the total count number at 55.5 to 56.5 is taken as (m/z) 56, the total count number at 58.5 to 59.5 is taken as (m/z) 59, and the total count number at 134.5 to 135.5 is taken as (m/z) 135.

Usually, TOF-SIMS is a surface analysis method, and data in the depth direction are about 1 nm data. Therefore, the intensity inside the toner is determined by sputtering the toner with argon gas cluster ions and scraping the surface.

Sputtering conditions are as follows.

Accelerating voltage: 10 kV

Current: 3.4 nA

Raster: 600 μm

Irradiation time: 5 s

The depth measurement was performed by sputtering a PMMA film under the same conditions in advance to confirm the relationship with the irradiation time, and it was confirmed that 100 nm was cut in 300 s.

In the toner of the present invention, the intensity at 100 nm from the toner surface is taken as a value obtained by measuring secondary ion mass/secondary ion charge number (m/z) when sputtering 120 times under the above conditions.

Method for Measuring Glass Transition Temperature (Tg)

The glass transition temperature (Tg) is measured according to ASTM D3418-82 by using a differential scanning calorimeter "Q2000" (manufactured by TA Instruments).

A total of 2 mg of the measurement sample is accurately weighed and placed in an aluminum pan; an empty aluminum pan is used as a reference.

The measurement temperature range is set to from 30° C. to 200° C., the temperature is raised from 30° C. to 200° C. at a temperature increase rate of 10° C./min, then the temperature is lowered from 200° C. to 30° C. at a temperature decrease rate of 10° C./min, and the temperature is thereafter again raised to 200° C. at a temperature increase rate of 10° C./min.

In the DSC curve obtained in the second temperature raising process, the intersection of the baseline intermediate line before and after the specific heat change and the differential heat curve is defined as the glass transition temperature (Tg).

EXAMPLES

Hereinafter, the present invention will be described in greater detail with reference to Examples and Comparative Examples, but the present invention is not limited thereto. "Parts" used in Examples and Comparative Examples are based on mass unless otherwise specified.

Production Example of Magnetic Body 1

A total of 1.0 equivalent of a caustic soda solution (including 1% by mass of sodium hexametaphosphate in terms of P with respect to Fe) with respect to an iron ion was mixed with an aqueous ferrous sulfate solution to prepare an aqueous solution including ferrous hydroxide. Air was blown in, and an oxidation reaction was performed at 80° C., while maintaining the aqueous solution at pH 9, to prepare a slurry liquid for generating seed crystals.

Next, an aqueous ferrous sulfate solution was added to the slurry liquid so as to obtain 1.0 equivalent to the initial alkali amount (sodium component of caustic soda). The slurry liquid was maintained at pH 8, the oxidation reaction was advanced while blowing air, and the pH was adjusted to 6 at the end of the oxidation reaction to obtain magnetic iron oxide particles.

As a silane coupling agent, 1.50 parts of n-$C_6H_{13}Si(OCH_3)_3$ was added to 100 parts of the obtained magnetic iron oxide particles, and sufficiently stirred.

The produced hydrophobic magnetic iron oxide particles were washed, filtered and dried by a conventional method.

After the agglomerated particles were crushed, heat treatment was performed at a temperature of 70° C. for 5 h to obtain magnetic body 1. The number average particle diameter of the magnetic body was 270 nm.

Production Example of Magnetic Body 2

Magnetic body 2 was obtained in the same manner as in Production Example of Magnetic Body 1, except that the oxidation reaction time was changed and the amount of the silane coupling agent added was 2.00 parts with respect to 100 parts of magnetic iron oxide. The number average particle diameter of the magnetic body 2 was 270 nm.

Production Example of Magnetic Body 3

Magnetic body 3 was obtained in the same manner as in Production Example of Magnetic Body 1, except that the oxidation reaction time was changed and the amount of the silane coupling agent added was 2.50 parts with respect to 100 parts of magnetic iron oxide. The number average particle diameter of the magnetic body 3 was 350 nm.

Production Example of Magnetic Body 4

Magnetic body 4 was obtained in the same manner as in Production Example of Magnetic Body 1, except that the oxidation reaction time was changed and the amount of the silane coupling agent added was 1.00 part with respect to 100 parts of magnetic iron oxide. The number average particle diameter of the magnetic body 4 was 270 nm.

TABLE 1

| Magnetic body No. | Number average particle diameter (nm) | Hydrophobizing treatment agent addition amount (parts) |
|---|---|---|
| 1 | 270 | 1.50 |
| 2 | 270 | 2.00 |
| 3 | 350 | 2.50 |
| 4 | 270 | 1.00 |

Production Example of Polyester Resin

| | |
|---|---|
| Terephthalic acid | 30.0 parts |
| Trimellitic acid | 5.0 parts |
| Bisphenol A ethylene oxide (2 mol) adduct | 160.0 parts |
| Dibutyltin oxide | 0.1 part |

The above materials were placed into a heat-dried two-necked flask, nitrogen gas was introduced into the container, and the temperature was raised while stirring in an inert atmosphere. Thereafter, a condensation polymerization reaction was performed while raising the temperature from 150° C. to 220° C. over about 12 h, and then a polycondensation reaction was advanced while reducing the pressure in the range of 210° C. to 250° C. to obtain a polyester resin.

The number average molecular weight (Mn) of the polyester resin was 21,200, the weight average molecular weight (Mw) was 84,500, and the glass transition temperature (Tg) was 79.0° C.

Production Example of Toner Particles 1

An aqueous medium including a dispersion stabilizer was obtained by adding 450 parts of a 0.1 mol/L-$Na_3PO_4$ aqueous solution to 720 parts of ion exchanged water, heating to 60° C. and then adding 67.7 parts of a 1.0 mol/L-$CaCl_2$ aqueous solution.

| | |
|---|---|
| Styrene | 78.00 parts |
| n-Butyl acrylate | 22.00 parts |
| Polypropylene glycol #400 diacrylate (APG400) | 1.50 parts |
| Polyester resin | 3.00 parts |
| Negative charge control agent T-77 (Hodogaya Chemical Co., Ltd.) | 1.00 part |
| Magnetic body 1 | 65.00 parts |

The above formulation was uniformly dispersed and mixed using an attritor (Nippon Coke & Engineering Co., Ltd.).

The obtained monomer composition was heated to a temperature of 60° C., and the following materials were mixed and dissolved therein to obtain a polymerizable monomer composition.

| | |
|---|---|
| Release agent (Fischer Tropsch wax (HNP-51, manufactured by Nippon Seiro Co., Ltd.)) | 15.00 parts |
| Polymerization initiator (t-butyl peroxypivalate (25% toluene solution)) | 10.00 parts |

The polymerizable monomer composition was placed into an aqueous medium and granulated by stirring at 22,000 rpm for 15 min with a TK Homomixer (Tokushu Kika Kogyo Co., Ltd.) at a temperature of 60° C. in a nitrogen atmosphere. Thereafter, stirring was performed with a paddle stirring blade, and a polymerization reaction was conducted at a reaction temperature of 70° C. for 300 min.

Thereafter, the obtained suspension was cooled to room temperature at 3° C. per minute, and hydrochloric acid was added to dissolve the dispersion stabilizer, followed by filtration, washing with water and drying to obtain toner particles 1. The formulations and various physical properties of the obtained toner particles 1 are shown in Tables 2 and 3.

Production Example of Toner Particles 2

Toner particles 2 were obtained in the same manner as in Production Example of Toner Particles 1 except that the number of added parts of the magnetic body 1 was changed to 30.00 parts, and 1.00 part of polyethylene glycol #400 diacrylate (A400) was added instead of polypropylene glycol #400 diacrylate (APG400). The formulations and various physical properties of the obtained toner particles 2 are shown in Tables 2 and 3.

Production Example of Toner Particles 3

Toner particles 3 were obtained in the same manner as in Production Example of Toner Particles 1 except that the number of added parts of the magnetic body 1 was changed to 85.00 parts, and 2.00 parts of polytetrapropylene glycol #650 diacrylate (A-PTMG-65) was added instead of polypropylene glycol #400 diacrylate (APG400). The formulations and various physical properties of the obtained toner particles 3 are shown in Tables 2 and 3.

Production Example of Toner Particles 4

Toner particles 4 were obtained in the same manner as in Production Example of Toner Particles 1 except that the number of added parts of the magnetic body 1 was changed to 25.00 parts. The formulations and various physical properties of the obtained toner particles 4 are shown in Tables 2 and 3.

Production Example of Toner Particles 5

Toner particles 5 were obtained in the same manner as in Production Example of Toner Particles 4 except that the magnetic body 1 was replaced with the magnetic body 2. The formulations and various physical properties of the obtained toner particles 5 are shown in Tables 2 and 3.

Production Example of Toner Particles 6

Toner particles 6 were obtained in the same manner as in Production Example of Toner Particles 1 except that the magnetic body 1 were replaced with the magnetic body 3. The formulations and various physical properties of the obtained toner particles 6 are shown in Tables 2 and 3.

Production Example of Toner Particles 7

Toner particles 7 were obtained in the same manner as in Production Example of Toner Particles 4 except that the addition amount of the magnetic body 1 was changed to 20.00 parts. The formulations and various physical properties of the obtained toner particles 7 are shown in Tables 2 and 3.

Production Example of Toner Particles 8

Toner particles 8 were obtained in the same manner as in Production Example of Toner Particles 1 except that the addition amount of the magnetic body 1 was changed to 90.00 parts. The formulations and various physical properties of the obtained toner particles 8 are shown in Tables 2 and 3.

Production Example of Toner Particles 9

Toner particles 9 were obtained in the same manner as in Production Example of Toner Particles 8 except that the magnetic body 1 were replaced with the magnetic body 4. The formulations and various physical properties of the obtained toner particles 9 are shown in Tables 2 and 3.

Production Example of Toner Particles 10

Toner particles 10 were obtained in the same manner as in Production Example of Toner Particles 8 except that the addition amount of the magnetic body 1 was changed to 100.00 parts. The formulations and various physical properties of the obtained toner particles 10 are shown in Tables 2 and 3.

Production Example of Toner Particles 11

Toner particles 11 were obtained in the same manner as in Production Example of Toner Particles 1 except that 3.00 parts of polypropylene glycol #700 diacrylate (APG700) was added instead of 1.50 parts of polypropylene glycol #400 diacrylate (APG400). The formulations and various physical properties of the obtained toner particles 11 are shown in Tables 2 and 3.

Production Example of Toner Particles 12

Toner particles 12 were obtained in the same manner as in Production Example of Toner Particles 1 except that 0.70 parts of polypropylene glycol #200 diacrylate (APG200) was added instead of 1.50 parts of polypropylene glycol #400 diacrylate (APG400). The formulations and various physical properties of the obtained toner particles 12 are shown in Tables 2 and 3.

Production Example of Toner Particles 13

Toner particles 13 were obtained in the same manner as in Production Example of Toner Particles 12 except that the addition amount of polypropylene glycol #200 diacrylate (APG200) was changed to 0.50 parts. The formulations and various physical properties of the obtained toner particles 13 are shown in Tables 2 and 3.

Production Example of Toner Particles 14

Toner particles 14 were obtained in the same manner as in Production Example of Toner Particles 13 except that 0.50 parts of polypropylene glycol #100 diacrylate (APG100) was added instead of 0.50 parts of polypropylene glycol #200 diacrylate (APG200). The formulations and various physical properties of the obtained toner particles 14 are shown in Tables 2 and 3.

Production Example of Toner Particles 15

Toner particles 15 were obtained in the same manner as in Production Example of Toner Particles 14 except that the addition amount of polypropylene glycol #100 diacrylate (APG100) was changed to 0.20 parts. The formulations and various physical properties of the obtained toner particles 15 are shown in Tables 2 and 3.

Production Example of Toner Particles 16

Toner particles 16 were obtained in the same manner as in Production Example of Toner Particles 14 except that the addition amount of polypropylene glycol #100 diacrylate (APG100) was changed to 0.10 parts. The formulations and various physical properties of the obtained toner particles 16 are shown in Tables 2 and 3.

Production Example of Toner Particles 17

Toner particles 17 were obtained in the same manner as in Production Example of Toner Particles 2 except that 0.07 parts of polypropylene glycol #100 diacrylate (APG100) was added instead of 1.00 part of polyethylene glycol #400 diacrylate (A400). The formulations and various physical properties of the obtained toner particles 17 are shown in Tables 2 and 3.

Production Example of Toner Particles 18

Toner particles 18 were obtained in the same manner as in Production Example of Toner Particles 17 except that the addition amount of magnetic body 1 was changed to 20.00 parts, the negative charge control agent T-77 was not added, and the number of parts added of styrene and n-butyl acrylate was changed as follows. The formulations and various physical properties of the obtained toner particles 18 are shown in Tables 2 and 3.

| | |
|---|---|
| Styrene | 72.00 parts |
| N-butyl acrylate | 28.00 parts |

Production Example of Toner Particles 19

Toner particles 19 were obtained in the same manner as in Production Example of Toner Particles 1 except that 0.60 parts of 1,6-hexanediol diacrylate (HDDA in the table) was used instead of 1.50 parts of polypropylene glycol #400 diacrylate (APG400). The formulations and various physical properties of the obtained toner particles 19 are shown in Tables 2 and 3.

Production Example of Toner Particles 20

Toner particles 20 were obtained in the same manner as in Production Example of Toner Particles 1 except that 1.50 parts of ethoxylated bisphenol A diacrylate (A-BPE-10) was used instead of 1.50 parts of polypropylene glycol #400 diacrylate (APG400). The formulations and various physical properties of the obtained toner particles 20 are shown in Tables 2 and 3.

Production Example of Toner Particles 21

An aqueous medium including a dispersion stabilizer was obtained by adding 450 parts of a 0.1 mol/L-$Na_3PO_4$ aqueous solution to 720 parts of ion exchanged water, heating to 60° C. and then adding 67.7 parts of a 1.0 mol/L-$CaCl_2$ aqueous solution.

| | |
|---|---|
| Styrene | 78.00 parts |
| n-Butyl acrylate | 22.00 parts |
| Polypropylene glycol #400 diacrylate (APG400) | 1.50 parts |

The above formulation was uniformly dispersed and mixed using an attritor (Nippon Coke & Engineering Co., Ltd.).

The obtained monomer composition was heated to a temperature of 60° C., and the following material was mixed and dissolved therein to obtain a polymerizable monomer composition.

| | |
|---|---|
| Polymerization initiator (t-butyl peroxypivalate (25% toluene solution)) | 10.00 parts |

The polymerizable monomer composition was placed into an aqueous medium and granulated by stirring at 22,000 rpm for 15 min with a TK Homomixer (Tokushu Kika Kogyo Co., Ltd.) at a temperature of 60° C. in a nitrogen atmosphere. Thereafter, stirring was performed with a paddle stirring blade, and a polymerization reaction was conducted at a reaction temperature of 70° C. for 300 min.

Thereafter, the obtained suspension was cooled to room temperature at 3° C. per minute, and hydrochloric acid was added to dissolve the dispersion stabilizer, followed by filtration, washing with water and drying to obtain resin particles 1.

| | |
|---|---|
| Resin particles 1 | 101.50 parts |
| Magnetic body 1 | 65.00 parts |
| Polyester resin | 3.00 parts |
| Negative charge control agent T-77 (Hodogaya Chemical Co., Ltd.) | 1.00 part |
| Release agent (Fischer Tropsch wax (HNP-51, manufactured by Nippon Seiro Co., Ltd.)) | 15.00 parts |

The above materials were premixed with an FM mixer (Nippon Coke & Engineering Co., Ltd.), and the mixture was melt-kneaded using a twin-screw extruder (trade name: PCM-30, manufactured by Ikegai Iron Works Co., Ltd.). The temperature was set so that the melt temperature at the discharge port was 150° C.

The obtained kneaded product was cooled, coarsely pulverized with a hammer mill, and then finely pulverized using a pulverizer (trade name: TURBO MILL T250, manufactured by Turbo Kogyo Co., Ltd.).

The obtained finely pulverized product was classified using a multi-division classifier utilizing the Coanda effect to obtain toner particles 21. The formulations and various physical properties of the obtained toner particles 21 are shown in Tables 2 and 3.

Production Example of Toner Particles 22

Production Example of Example of Amorphous Polyester Resin 1

| | |
|---|---|
| Terephthalic acid | 50.0 parts |
| Dodecenylsuccinic acid | 5.0 parts |
| Trimellitic acid (TMA in the table) | 10.2 parts |
| Bisphenol A ethylene oxide (2 mol) adduct | 80.0 parts |
| Bisphenol A propylene oxide (2 mol) adduct | 74.0 parts |
| Dibutyltin oxide | 0.1 part |

The above materials were placed into a heat-dried two-necked flask, nitrogen gas was introduced into the container, and the temperature was raised while stirring in an inert atmosphere. Thereafter, a condensation polymerization reaction was carried out at 150° C. to 230° C. for about 10 h. Thereafter, the pressure was gradually reduced at 210° C. to 250° C. to obtain an amorphous polyester resin 1.

The number average molecular weight (Mn) of the amorphous polyester resin 1 was 21,200, the weight average molecular weight (Mw) was 98,000, the glass transition temperature (Tg) was 59.0° C., and the softening point (Tm) was 119.8° C.

| | |
|---|---|
| Amorphous polyester resin 1 | 100.00 parts |
| Magnetic body 1 | 65.00 parts |
| Release agent (Fischer Tropsch wax (HNP-51, manufactured by Nippon Seiro Co., Ltd.)) | 5.00 parts |
| Negative charge control agent (T-77, manufactured by Hodogaya Chemical Co.,Ltd.) | 2.00 parts |

The above materials were premixed with an FM mixer (Nippon Coke & Engineering Co., Ltd.), and the mixture was melt-kneaded using a twin-screw extruder (trade name: PCM-30, manufactured by Ikegai Iron Works Co., Ltd.). The temperature was set so that the melt temperature at the discharge port was 150° C.

The obtained kneaded product was cooled, coarsely pulverized with a hammer mill, and then finely pulverized using a pulverizer (trade name: TURBO MILL T250, manufactured by Turbo Kogyo Co., Ltd.). The obtained finely pulverized product was classified using a multi-division classifier utilizing the Coanda effect to obtain toner particles 22. The formulations and various physical properties of the obtained toner particles 22 are shown in Tables 2 and 3.

Production Example of Toner Particles 23

Toner particles 23 were obtained in the same manner as in Production Example of Toner Particles 10 except that 0.07 parts of polyethylene glycol #400 diacrylate (A400) was used instead of 1.50 parts of polypropylene glycol #400 diacrylate (APG400). The formulations and various physical properties of the obtained toner particles 23 are shown in Tables 2 and 3.

TABLE 2

| Toner particle No. | Magnetic body No. | Number of added parts of magnetic body | Type of crosslinking agent | Number of added parts of crosslinking agent | Weight average particle diameter of toner particles (μm) | Tg (° C.) |
|---|---|---|---|---|---|---|
| 1 | 1 | 65.00 | APG400 | 1.50 | 7.3 | 60.1 |
| 2 | 1 | 30.00 | A400 | 1.00 | 7.2 | 59.8 |
| 3 | 1 | 85.00 | A-PTMG-65 | 2.00 | 7.3 | 60.2 |
| 4 | 1 | 25.00 | APG400 | 1.50 | 7.5 | 60.1 |
| 5 | 2 | 25.00 | APG400 | 1.50 | 7.3 | 60.0 |
| 6 | 3 | 65.00 | APG400 | 1.50 | 7.3 | 60.1 |
| 7 | 1 | 20.00 | APG400 | 1.50 | 7.3 | 59.8 |
| 8 | 1 | 90.00 | APG400 | 1.50 | 7.3 | 59.7 |
| 9 | 4 | 90.00 | APG400 | 1.50 | 7.4 | 59.6 |
| 10 | 1 | 100.00 | APG400 | 1.50 | 7.3 | 59.5 |
| 11 | 1 | 65.00 | APG700 | 3.00 | 7.3 | 59.4 |
| 12 | 1 | 65.00 | APG200 | 0.70 | 7.5 | 59.3 |
| 13 | 1 | 65.00 | APG200 | 0.50 | 7.3 | 59.2 |
| 14 | 1 | 65.00 | APG100 | 0.50 | 7.4 | 59.1 |
| 15 | 1 | 65.00 | APG100 | 0.20 | 7.3 | 59.4 |
| 16 | 1 | 65.00 | APG100 | 0.10 | 7.5 | 58.9 |
| 17 | 1 | 30.00 | APG100 | 0.07 | 7.3 | 59.5 |
| 18 | 1 | 20.00 | APG100 | 0.07 | 7.3 | 50.1 |
| 19 | 1 | 65.00 | HDDA | 0.60 | 7.4 | 57.9 |
| 20 | 1 | 65.00 | A-BPE-10 | 1.50 | 7.3 | 59.8 |
| 21 | 1 | 65.00 | APG400 | 1.50 | 7.4 | 60.4 |
| 22 | 1 | 65.00 | TMA | 10.20 | 7.3 | 60.1 |
| 23 | 1 | 100.00 | A400 | 0.07 | 7.3 | 59.9 |

TABLE 3

| Toner particle No. | B | B/A | C | Surface presence ratio (%) | Degree of uneven surface distribution number % | Degree of uneven surface distribution Determination | F/(D + E) |
|---|---|---|---|---|---|---|---|
| 1 | 1450 | 1.55 | 680 | 45 | 100 | Y | 0.10 |
| 2 | 1270 | 1.48 | 653 | 20 | 93 | Y | 0.60 |
| 3 | 1510 | 1.47 | 787 | 60 | 98 | Y | 0.65 |
| 4 | 1230 | 1.41 | 695 | 14 | 85 | Y | 0.10 |
| 5 | 1170 | 1.40 | 670 | 12 | 76 | Y | 0.10 |
| 6 | 1180 | 1.41 | 666 | 14 | 68 | N | 0.10 |
| 7 | 1130 | 1.36 | 682 | 9 | 98 | Y | 0.10 |
| 8 | 1530 | 1.43 | 841 | 65 | 88 | Y | 0.10 |
| 9 | 1550 | 1.41 | 875 | 69 | 95 | Y | 0.10 |
| 10 | 1560 | 1.35 | 955 | 73 | 88 | Y | 0.10 |
| 11 | 1470 | 1.57 | 671 | 48 | 98 | Y | 0.03 |
| 12 | 1350 | 1.45 | 723 | 46 | 96 | Y | 0.40 |
| 13 | 1270 | 1.37 | 757 | 43 | 97 | Y | 0.50 |
| 14 | 1300 | 1.33 | 817 | 43 | 96 | Y | 0.50 |
| 15 | 1180 | 1.31 | 762 | 44 | 95 | Y | 1.00 |
| 16 | 1140 | 1.31 | 736 | 44 | 96 | Y | 1.50 |
| 17 | 1050 | 1.30 | 687 | 17 | 89 | Y | 1.70 |
| 18 | 610 | 1.30 | 399 | 9 | 77 | Y | 1.78 |
| 19 | 1010 | 1.08 | 898 | 45 | 94 | Y | 1.55 |
| 20 | 1050 | 1.06 | 961 | 45 | 93 | Y | 1.59 |
| 21 | 880 | 1.01 | 867 | 4 | 43 | N | 1.81 |
| 22 | 590 | 1.02 | 573 | 7 | 40 | N | 1.79 |
| 23 | 1010 | 1.06 | 924 | 71 | 92 | Y | 1.87 |

In the table,

Y represents that the degree of uneven surface distribution of a magnetic body is favorable, and N represents that the degree of uneven surface distribution of a magnetic body is not favorable.

Production Example of Toner 1

A total of 0.3 parts of sol-gel silica fine particles having a number average particle diameter of primary particles of 110 nm were added to 100 parts of the toner particles 1 and mixed using an FM mixer (manufactured by Nippon Coke & Engineering Co., Ltd.).

Thereafter, 0.6 parts of hydrophobic silica fine particles that were obtained by treating silica fine particles having a number average particle diameter of primary particles of 12 nm with hexamethyldisilazane and then treating with silicone oil and that had a BET specific surface area value of 200 $m^2/g$ after the treatment were added and mixed in the same manner by using an FM mixer (manufactured by Nippon Coke & Engineering Co., Ltd.) to obtain a toner 1.

Example 1

An electrophotographic apparatus for evaluation was made by modifying the HP printer (LaserJetPro m203dw) using a cleanerless system so as to increase the process speed by a factor of 1.3 and obtain a fixing nip pressure of 80% of the default setting.

Further, CF230X was used as a toner cartridge, 150 g of the toner 1 was filled, and the following evaluation was performed. The evaluation results are shown in Table 4.

Evaluation 1: Evaluation of Line Width Maintenance Ratio (in a High-Temperature and High-Humidity Environment)

The evaluation of the line width maintenance ratio was performed in a high-temperature and high-humidity environment (temperature 32.5° C., relative humidity 80%), which is a severe environment for embedding external additives during toner deterioration.

Assuming a long-term durability test, the evaluation was performed in a mode in which the print percentage was lower than usual and severe with respect to toner deterioration. Specifically, a durability test was performed on a total of 7000 prints, with one horizontal line pattern in which a horizontal line of 2 dots had a print percentage of 1% as one job.

Rough paper COTTON BOND LIGHT COCKLE (basis weight 75 g) was used as evaluation paper.

On the first and 7000-th sheets, an image in which ten 2-dot horizontal lines (line approximately 85 μm wide as a latent image on the photosensitive drum) were printed with a leading edge margin of 10 mm and a horizontal line interval of 10 mm was outputted.

Then, the lines of the image were observed with a loupe, and the average line width of 10 lines was obtained. Specifically, 10 line widths were measured for each line, and the average value of the line widths of 10 lines was determined.

Then, by dividing the average value of the line width in the image after 7000 prints by the average value of the line width in the first image and multiplying by 100, the line width maintenance ratio was obtained and determined according to the following criteria.

A. The line width maintenance ratio is 95% or more.

B. The line width maintenance ratio is from 90% to less than 95%.

C. The line width maintenance ratio is from 80% to less than 90%.

D. The line width maintenance ratio is less than 80%.

Evaluation 2: Evaluation of Line Width Stability (in a Low-Temperature and Low-Humidity Environment)

The evaluation of line width stability was performed in a low-temperature and low-humidity environment (temperature 15° C., relative humidity 10%), which is an environment severe for toner cracking during toner deterioration.

Assuming a long-term durability test, the evaluation was performed in a mode in which the print percentage was lower than usual and severe with respect to toner deterioration. Specifically, a durability test was performed on a total of 7000 prints, with one horizontal line pattern in which a horizontal line of 2 dots had a print percentage of 1% as one job.

Rough paper COTTON BOND LIGHT COCKLE (basis weight 75 g) was used as evaluation paper.

On the 7000-th sheet, a check image having a vertical line after outputting a solid white image and a vertical line after outputting a solid black image was outputted.

Specifically, an image in which 10 vertical lines of 2 dots and a length of 40 mm were arranged at 15 mm intervals with a leading edge margin of 50 mm and left and right margins of 5 mm after the leading edge margin, thereafter a solid black band image of 50 mm length and 200 mm width was arranged, and then 10 vertical lines (vertical lines after outputting a solid black image) of 2 dots and a length of 40 mm were arranged at 15 mm intervals was outputted as the check image.

On the 7000-th print, the vertical lines after the output of the solid white image and the vertical line width after outputting the solid black image were observed using a loupe.

First, for the vertical line width after the output of the solid white image, each line width was measured at a position 20 mm upstream where the output of the solid black image was started, and the average value was taken as the line width after the output of the solid white image.

Next, for the line width after the output of the solid black image, each line width was measured at a position 20 mm downstream from the end of the output of the solid black image, and the average value was taken as the vertical line width after the output of the solid black image.

Then, the absolute value of the difference between the line width after the output of the solid black image and the line width after the output of the solid white image was divided by the line width after the output of the solid white image and multiplied by 100 to obtain the white/black change rate of the line width.

The smaller the white/black change rate of the line width, the higher the line width stability. In the present invention, the determination was made based on the following criteria.

A. The white/black change rate of the line width is less than 5%.

B. The white/black change rate of the line width is from 5% to less than 10%.

C. The white/black change rate of the line width is from 10% to less than 20%.

D. The white/black change rate of the line width is 20% or more.

Evaluation 3: Tape Peeling Resistance (Low-Temperature Fixing Performance) (in a Low-Temperature and Low-Humidity Environment)

The tape peeling resistance was evaluated in a low-temperature and low-humidity environment (temperature 15° C., relative humidity 10%), which is a severe environment for evaluating the low-temperature fixing performance.

Rough paper COTTON BOND LIGHT COCKLE (basis weight 90 g) was used as evaluation paper, and evaluation was performed by placing an image at the rear end with respect to the paper conveying direction.

This is because it was considered that the heat of the fixing device is taken away by the paper, so that the rear end side of the paper is under more severe conditions for fixing the toner.

Specifically, the fixing temperature was changed in increments of 5° C., and at each temperature level, an image having 10 vertical lines of 4 dots arranged at intervals of 5 mm with a leading edge margin of 250 mm and a left and right margin of 80 mm was outputted.

Then, a polyester tape (No. 5515, manufactured by Nichiban Co., Ltd.) was pasted on the portion of the image with 10 vertical lines that was obtained at each temperature level, and the polyester tape was stuck to the image by reciprocating a 100 g load three times on the polyester tape. Then, the polyester tape was peeled off, the temperature level at which the number of lines in which chipping or peeling occurred became one or less was taken as the tape peeling resistance lower limit temperature, and it was determined that the lower the tape peeling resistance lower limit temperature, the better the fixing performance.

Evaluation Criteria

A. The tape peeling resistance lower limit temperature is less than 190° C.

B. The tape peeling resistance lower limit temperature is from 190° C. to less than 200° C.

C. The tape peeling resistance lower limit temperature is from 200° C. to less than 210° C.

D. The tape peeling resistance lower limit temperature is 210° C. or more.

Evaluation 4: Rubbing Resistance (Low-Temperature Fixing Performance) (in a Low-Temperature and Low-Humidity Environment)

The evaluation of rubbing resistance was performed in a low-temperature and low-humidity environment (temperature 15° C., relative humidity 10%), which is a severe environment for evaluating the low-temperature fixing performance.

Rough paper COTTON BOND LIGHT COCKLE (basis weight 90 g) was used as evaluation paper, and the evaluation was performed by placing an image having a halftone portion at the rear end with respect to the paper conveying direction.

This is because it was considered that the heat of the fixing device is taken away by the paper, so that the rear end side of the paper is under more severe conditions for fixing the toner, and that the halftone image including many isolated dots is an image that is under more severe conditions with respect to rubbing Specifically, the fixing temperature was changed in increments of 5° C., and at each temperature level, an image having 10 vertical lines of 4 dots arranged at intervals of 5 mm with a leading edge margin of 250 mm and a left and right margin of 80 mm was outputted.

Then, a polyester tape (No. 5515, manufactured by Nichiban Co., Ltd.) was pasted on the portion of the image with 10 vertical lines that was obtained at each temperature level, and the polyester tape was stuck to the image by reciprocating a 100 g load three times on the polyester tape. Then, the polyester tape was peeled off, the temperature level at which the number of lines in which chipping or peeling occurred became one or less was taken as the tape peeling resistance lower limit temperature, and it was determined that the lower the tape peeling resistance lower limit temperature, the better the fixing performance.

Evaluation Criteria

A. The tape peeling resistance lower limit temperature is less than 190° C.

B. The tape peeling resistance lower limit temperature is from 190° C. to less than 200° C.

C. The tape peeling resistance lower limit temperature is from 200° C. to less than 210° C.

D. The tape peeling resistance lower limit temperature is 210° C. or higher.

Evaluation 5: Letter Reproducibility (Durability) (in a High-Temperature and High-Humidity Environment)

Evaluation of letter reproducibility was performed in a high-temperature and high-humidity environment (temperature 32.5° C., relative humidity 80%) which is a severe environment for embedding external additives during toner deterioration.

Assuming a long-term durability test, the evaluation was performed in a mode in which the print percentage was lower than usual and severe with respect to toner deterioration. Specifically, a durability test was performed on a total of 7000 prints, with one horizontal line pattern in which a horizontal line of 2 dots had a print percentage of 1% as one job.

Rough paper COTTON BOND LIGHT COCKLE (basis weight 75 g) was used as evaluation paper.

Then, on the 7000-th print, an image in which 100 (10×10) alphabetic E letters (8 points, font Mincho) were arranged at an interval of 10 mm with a leading and trailing end margin of 5 mm and a left and right margin of 5 mm was outputted.

Then, 100 E letters were observed with a loupe, the number of letters in which chipping has occurred was counted, and letter reproducibility was determined according to the following criteria.

A. There are less than 3 chipped letters.

B. There are from 3 to less than 6 chipped letters.

C. There are from 6 to less than 10 chipped letters.

D. There are 10 or more chipped letters.

Evaluation 6: Dot Reproducibility (Durability) (in a Low-Temperature and Low-Humidity Environment)

The dot reproducibility was evaluated in a low-temperature and low-humidity environment (temperature 15° C., relative humidity 10%) which is severe for toner cracking during toner deterioration.

Assuming a long-term durability test, the evaluation was performed in a mode in which the print percentage was lower than usual and severe with respect to toner deterioration. Specifically, a durability test was performed on a total of 7000 prints, with one horizontal line pattern in which a horizontal line of 2 dots had a print percentage of 1% as one job.

Rough paper COTTON BOND LIGHT COCKLE (basis weight 75 g) was used as evaluation paper.

On the 7000-th sheet, a halftone image formed by isolated dots was outputted (dot print percentage 10%) with a leading and trailing edge margin of 5 mm and a left and right margin of 5 mm.

In the image, 100 isolated dots were randomly observed using a loupe, and the ratio of the major axis to the minor axis (value obtained by dividing the major axis by the minor axis) was determined by measuring the minor axis and major axis of each dot. The dot reproducibility was the determined according to the following criteria by using the maximum value of the ratio of the major axis to the minor axis among 100 isolated dots.

A. The maximum value of the ratio of the major axis to the minor axis is less than 1.10.

B. The maximum value of the ratio of the major axis to the minor axis is from 1.10 to less than 1.20.

C. The maximum value of the ratio of the major axis to the minor axis is from 1.20 to less than 1.30.

D. The maximum value of the ratio of the major axis to the minor axis is 1.30 or more.

Production Examples of Toners 2 to 18 and Comparative Toners 1 to 5

Toners 2 to 18 and comparative toners 1 to 5 were obtained in the same manner as in Production Example of Toner 1, except that the toner particles shown in Table 4 were used.

Examples 2 to 18, Comparative Examples 1 to 5

The same evaluation as in Example 1 was performed using toners 2 to 18 and comparative toners 1 to 5. The evaluation results are shown in Table 4.

TABLE 4

| | Toner No. | Toner particle No. | Evaluation 1 (%) | | Evaluation 2 (%) | | Evaluation 3 (° C.) | | Evaluation 4 (° C.) | | Evaluation 5 (number) | | Evaluation 6 | |
|---|---|---|---|---|---|---|---|---|---|---|---|---|---|---|
| Example 1 | 1 | 1 | A | 99 | A | 2 | A | 180 | A | 175 | A | 0 | A | 1.02 |
| Example 2 | 2 | 2 | A | 99 | A | 2 | A | 180 | B | 190 | A | 0 | A | 1.03 |
| Example 3 | 3 | 3 | A | 99 | A | 2 | A | 180 | B | 190 | A | 0 | A | 1.04 |
| Example 4 | 4 | 4 | A | 99 | A | 2 | A | 180 | A | 175 | A | 2 | A | 1.05 |
| Example 5 | 5 | 5 | B | 94 | A | 2 | A | 180 | A | 175 | B | 3 | A | 1.06 |
| Example 6 | 6 | 6 | B | 94 | A | 2 | A | 180 | A | 175 | C | 6 | A | 1.04 |
| Example 7 | 7 | 7 | B | 94 | B | 7 | B | 190 | A | 180 | C | 7 | A | 1.06 |
| Example 8 | 8 | 8 | A | 99 | A | 2 | A | 185 | A | 185 | A | 0 | A | 1.05 |
| Example 9 | 9 | 9 | A | 99 | A | 2 | B | 190 | B | 190 | A | 0 | A | 1.06 |
| Example 10 | 10 | 10 | A | 99 | B | 7 | C | 200 | C | 200 | A | 0 | A | 1.07 |
| Example 11 | 11 | 11 | A | 99 | A | 2 | A | 180 | A | 175 | A | 0 | A | 1.06 |
| Example 12 | 12 | 12 | A | 99 | A | 2 | A | 180 | A | 175 | A | 0 | A | 1.05 |
| Example 13 | 13 | 13 | A | 99 | B | 8 | B | 190 | A | 175 | A | 0 | A | 1.06 |
| Example 14 | 14 | 14 | A | 99 | C | 12 | C | 200 | B | 195 | A | 0 | A | 1.06 |
| Example 15 | 15 | 15 | B | 94 | C | 12 | C | 200 | B | 195 | A | 0 | A | 1.09 |
| Example 16 | 16 | 16 | B | 94 | C | 12 | C | 200 | B | 195 | A | 0 | B | 1.15 |
| Example 17 | 17 | 17 | C | 85 | C | 12 | C | 200 | B | 195 | B | 4 | C | 1.21 |
| Example 18 | 18 | 18 | C | 81 | C | 14 | C | 200 | B | 195 | C | 7 | C | 1.23 |
| Comp. Example 1 | Comp. 1 | 19 | C | 83 | D | 25 | D | 210 | C | 200 | C | 8 | D | 1.34 |
| Comp. Example 2 | Comp. 2 | 20 | C | 83 | D | 26 | D | 215 | C | 200 | C | 9 | D | 1.36 |
| Comp. Example 3 | Comp. 3 | 21 | C | 80 | D | 27 | D | 215 | C | 200 | D | 13 | C | 1.24 |
| Comp. Example 4 | Comp. 4 | 22 | D | 73 | D | 24 | C | 200 | C | 200 | D | 15 | D | 1.35 |
| Comp. Example 5 | Comp. 5 | 23 | C | 82 | D | 25 | D | 210 | D | 215 | B | 4 | C | 1.27 |

In the table, Comp. represents "Comparative".

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-230665, filed Dec. 10, 2018, which is hereby incorporated by reference herein in its entirety.

What is claimed is:

1. A toner, comprising:

a toner particle that includes a binder resin and a magnetic body in an amount of 25 to 90 parts by mass with respect to 100 parts by mass of the binder resin; and an external additive, wherein the magnetic body has a surface presence ratio of 12 to 69% obtained by image analysis using a scanning electron microscope of the toner particle surface at an accelerating voltage of 5.0 kV, and B≥600 and B/A≥1.30 when toner hardness A (N/m) is an average value of a slope in a displacement region of 0.00 to 0.20 μm in a load-displacement curve obtained by measuring the toner under a condition of a load application speed of 0.83 μN/sec where a load a mN is plotted against an ordinate, and a displacement amount b μm is plotted against an abscissa, and toner hardness B (N/m) is an average value of a slope in a displacement region of 0.00 to 0.20 μm in a load-displacement curve obtained by measuring the toner under a condition of a load application speed of 2.50 μN/sec where a load a mN is plotted against an ordinate, and a displacement amount b μm is plotted against an abscissa.

2. The toner according to claim 1, wherein toner hardness C (N/m) is 850 or less when a toner hardness value N/m is plotted against the ordinate, a load application speed μN/sec is plotted against the abscissa, and a segment of a straight line connecting A and B is taken as C when the load application speed is 0.00 μN/sec.

3. The toner according to claim 1, wherein 75 number % or more of the magnetic body are present within a distance of 0.15 times a projected area circle-equivalent diameter of a cross section of the toner particle from an outline of the cross section observed with a transmission electron microscope.

4. The toner according to claim 1, wherein the binder resin includes a vinyl resin having an ether structure.

5. The toner according to claim 4, wherein the binder resin includes a vinyl resin having a monomer unit derived from a crosslinking agent represented formula (4)

(4)

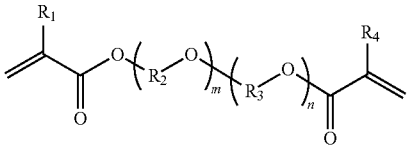

when m+n is an integer of 2 or more, $R_1$ and $R_4$ independently represent H or $CH_3$, and $R_2$ and $R_3$ independently represent a hydrocarbon group having a linear or branched chain having 2 to 12 carbon atoms.

6. The toner according to claim 4, wherein the binder resin includes a vinyl resin having a monomer unit derived from a crosslinking agent represented formula (5)

(5)

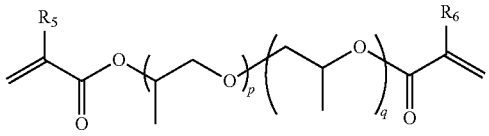

when p+q is an integer of 2 or more, and $R_5$ and $R_6$ independently represent H or $CH_3$.

7. The toner according to claim 1, wherein F/(D+E)≤1.50 when intensities of secondary ion mass/secondary ion charge number (m/z) of 59, 44, and 135 measured 100 nm from the toner particle surface by time-of-flight secondary ion mass spectrometry are respectively D ppm, E ppm, and F ppm.

8. The toner according to claim 1, wherein 2500≥B≥600.

9. The toner according to claim 1, wherein the binder resin is a vinyl resin.

10. The toner according to claim 1, wherein the binder resin is a styrene copolymer resin.

* * * * *